US010596528B2

(12) United States Patent
Nakao

(10) Patent No.: US 10,596,528 B2
(45) Date of Patent: Mar. 24, 2020

(54) NANOBUBBLE-PRODUCING APPARATUS

(71) Applicant: TOSSLEC Co., Ltd., Kyoto-shi (JP)

(72) Inventor: Junji Nakao, Kyoto (JP)

(73) Assignee: TOSSLEC CO., LTD., Kyoto-Shi, Kyoto (JP)

( * ) Notice: Subject to any disclaimer, the term of this patent is extended or adjusted under 35 U.S.C. 154(b) by 253 days.

(21) Appl. No.: 15/127,372

(22) PCT Filed: Mar. 25, 2015

(86) PCT No.: PCT/JP2015/059107
§ 371 (c)(1),
(2) Date: Sep. 19, 2016

(87) PCT Pub. No.: WO2015/147048
PCT Pub. Date: Oct. 1, 2015

(65) Prior Publication Data

US 2018/0178173 A1 Jun. 28, 2018

(30) Foreign Application Priority Data

Mar. 26, 2014 (JP) ..... 2014-064892

(51) Int. Cl.
*B01F 3/04* (2006.01)
*B01F 5/06* (2006.01)
(Continued)

(52) U.S. Cl.
CPC ..... *B01F 3/04985* (2013.01); *B01F 3/04503* (2013.01); *B01F 3/04978* (2013.01);
(Continued)

(58) Field of Classification Search
CPC ..... B01F 3/04985; B01F 5/0652; B01F 3/04503; B01F 5/0689; B01F 11/0258;
(Continued)

(56) References Cited

U.S. PATENT DOCUMENTS 9,868,092 B2 * 1/2018 Takahashi ..... B01F 3/04248
2015/0123295 A1 * 5/2015 Kerfoot ..... B01F 3/04588 261/93

FOREIGN PATENT DOCUMENTS

EP 3124109 A4 * 11/2017
JP 2001-225060 A 8/2001
(Continued)

OTHER PUBLICATIONS

International Search Report (ISR) (PCT Form PCT/ISA/210), in PCT/JP2015/059107, dated May 19, 2015.
(Continued)

*Primary Examiner* — Stephen Hobson
(74) *Attorney, Agent, or Firm* — McGinn IP Law Group, PLLC

(57) ABSTRACT

A nanobubble-producing apparatus includes a liquid vat provided with a bubble-containing-liquid inlet in an upper part thereof and a bubble-containing-liquid outlet in a bottom part thereof, a microbubble-containing-liquid supply unit to supply microbubble-containing liquid that contains microbubbles to the bubble-containing-liquid inlet of the liquid vat, an ultrasonic collapse unit to radiate ultrasonic waves to the inside of the liquid vat so that an ultrasonic collapse field in which the collapsing of the microbubbles with the ultrasonic waves is concentrated and nanobubbles are generated is formed at a location where the microbubble-containing liquid supplied into the liquid vat through the bubble-containing-liquid inlet flows downward, and a nanobubble-containing-liquid extraction portion where the nanobubble-containing liquid that contains the nanobubbles generated by the ultrasonic collapse unit is taken out of the liquid vat through the bubble-containing-liquid outlet.

19 Claims, 14 Drawing Sheets

(51) Int. Cl.
*B01F 5/10* (2006.01)
*B01F 11/02* (2006.01)
*B01F 5/00* (2006.01)

(52) U.S. Cl.
CPC ..... *B01F 5/0652* (2013.01); *B01F 5/0657* (2013.01); *B01F 5/0658* (2013.01); *B01F 5/0688* (2013.01); *B01F 5/0689* (2013.01); *B01F 5/106* (2013.01); *B01F 11/0258* (2013.01); *B01F 11/0283* (2013.01); *B01F 2003/04858* (2013.01); *B01F 2003/04886* (2013.01); *B01F 2005/0022* (2013.01)

(58) Field of Classification Search
CPC ..... B01F 5/0658; B01F 3/04978; B01F 11/0283; B01F 5/106; B01F 5/0688; B01F 5/0657; B01F 2003/04886; B01F 2005/0022; B01F 2003/04858
See application file for complete search history.

(56) References Cited

FOREIGN PATENT DOCUMENTS

| | | | | |
|---|---|---|---|---|
| JP | 2005-246293 | A | | 9/2005 |
| JP | 3762206 | B2 | | 4/2006 |
| JP | 2006-116365 | A | | 5/2006 |
| JP | 2006-136777 | A | | 6/2006 |
| JP | 2006-272232 | A | | 10/2006 |
| JP | 2006-289183 | A | | 10/2006 |
| JP | 2007-136255 | A | | 6/2007 |
| JP | 4094633 | B2 | | 6/2008 |
| JP | 2008-264771 | A | | 11/2008 |
| JP | 2008-296183 | A | | 12/2008 |
| JP | 2009-178683 | A | | 8/2009 |
| JP | 2011-020005 | A | | 2/2011 |
| JP | 2011-218308 | A | | 11/2011 |
| JP | 2014-050817 | A | | 3/2014 |
| JP | 6210917 | B2 | * | 10/2017 |
| WO | WO 2004/026452 | A1 | | 4/2004 |
| WO | WO 2010/134551 | A1 | | 11/2010 |
| WO | WO 2013/088668 | A1 | | 6/2013 |
| WO | WO-2015147048 | A1 | * | 10/2015 ..... B01F 5/0652 |

OTHER PUBLICATIONS

Mizuki Goto, "Studies Regarding the Generation and Mechanics of Nanobubbles" (in Japanese), Master's Thesis for Graduate School of Systems and Information Engineering, Jan. 2004, University of Tsukuba.
Decision to Grant a Patent dated Aug. 29, 2017.

* cited by examiner

NANOBUBBLE-PRODUCING APPARATUS

TECHNICAL FIELD

The present invention relates to a nanobubble-producing apparatus to produce nanobubble-containing liquid.

BACKGROUND ART

It is being started to consider utilizing various effects that micro/nanobubbles have for various fields such as washing, sterilization, organic synthesis or the like, as techniques to achieve ecological circumstances these days. Therefore various types of apparatus to produce micro/nanobubbles have been designed. Various mechanisms, for example, one described in Patent document 1 to which swirling flow method is applied, others described in Patent document 2, Patent document 3 and Patent document 4 to which pressurizing and shearing method is applied, have been developed.

RELATED ART DOCUMENTS

Patent Documents

Patent document 1: Japanese Unexamined Patent Application Publication No. 2006-116365.

Patent document 2: Japanese Unexamined Patent Application Publication No. 2006-272232.

Patent document 3: Japanese Patent No. 3762206.

Patent document 4: Japanese Patent No. 4094633.

SUMMARY OF THE INVENTION

Problems to be Solved by the Invention

However, every method cannot atomize and uniformize nanobubbles, and intermixes bubbles that are different in diameter besides, it is difficult to greatly increase concentration of bubbles because difference in the amount of electric charge and zeta potential of the bubbles causes cohesion of the bubbles with each other. Also, since most nanobubble-producing apparatuses according to existing inventions employ pressurizing and shearing method, metals such as stainless steel must be used for liquid contact parts so as to make structure be able to stand pressure. Examples of using resins such as PVC exist in some inventions (employing swirling flow method), nevertheless, it is a fact that those apparatuses are not nanobubble-producing apparatuses which generate atomized, uniformized and high-concentration nanobubbles but ones which generate a mixture of microbubbles and nanobubbles. In particular, prior arts cannot make diameter of nanoscale bubbles homogeneous (atomized and uniformized). Hence, according to the prior arts, there is necessarily need to produce shearing collapse under high water pressure so as to generate atomized, uniformized and high-concentration nanobubbles, as a result, significant restrictions regarding safety and quality rise due to causing corrosion or hydrogen embrittlement of stainless steel by ozone nanobubbles having strong oxidizing power, hydrogen nanobubbles having strong reducing power, and so on.

Also, it is clear that microscopic bubbles, which has high internal pressure as derived from the following Young-Laplace equation, tend to become smaller because internal pressure of all nanobubbles is equal to force directed to the inside of the bubbles.

$$\Delta P=4\sigma/D$$

($\Delta P$ is variation of increasing pressure, $\sigma$ is surface tension, D is diameter of a bubble. 100 nm: 30 Atom, 10 nm: 300 Atom.)

When bubbles are not atomized and uniformized in diameter, large bubbles absorb small bubbles so that the bubbles tend to become larger because each bubbles has different amount of electric charge and zeta potential. Bubbles having different diameters are affected by cohesion, become larger, surface and crumble away. Thereby those bubbles have a short lifetime and the malfunction such that the reproducibility of oxidation/reduction reactions and sterilizing effects is very low.

The present invention has paid attention to the above defects indwelling the prior arts, it is an object of the present invention to provide a nanobubble-producing apparatus being capable of obtaining high-concentration nanobubbles that are minute and have a uniform diameter.

Means of Solving the Problems

In order to solve the problem, the present invention employs the configurations described below.

That is, a nanobubble-producing apparatus according to the present invention is characterized by comprising a liquid vat provided with a bubble-containing-liquid inlet and a bubble-containing-liquid outlet, a microbubble-containing-liquid supply unit to supply microbubble-containing liquid that contains microbubbles to the bubble-containing-liquid inlet of the liquid vat, an ultrasonic collapse unit to radiate ultrasonic waves to the inside of the liquid vat so that an ultrasonic collapse field in which the collapsing of the microbubbles with the ultrasonic waves is concentrated and nanobubbles are generated is formed at a location where the microbubble-containing liquid supplied into the liquid vat through the bubble-containing-liquid inlet flows, and a nanobubble-containing-liquid extraction portion where nanobubble-containing liquid that contains the nanobubbles generated by the ultrasonic collapse unit is taken out of the liquid vat through the bubble-containing-liquid outlet, the ultrasonic collapse unit having an ultrasonic oscillator that is able to emit the ultrasonic waves, the liquid vat having an outer receptacle to which the ultrasonic oscillator is fixed and an inner receptacle that is formed inside the outer receptacle, the inner receptacle being provided with the bubble-containing-liquid inlet and the bubble-containing-liquid outlet, a medium-liquid retention area for storing medium liquid to propagate the ultrasonic waves to the inner receptacle being formed between the outer receptacle and the inner receptacle.

The present invention has been made by the inventors who first conceived the idea of forming the ultrasonic collapse field in that the collapsing of the microbubbles with the ultrasonic waves is concentrated and nanobubbles are generated.

Such configuration makes it possible to fabricate the nanobubble-producing apparatus being capable of obtaining high-concentration nanobubbles that are minute and have a uniform diameter.

According to the present invention, the bubble-containing-liquid inlet may be provided in an upper part of the liquid vat, and besides the bubble-containing-liquid outlet may be provided in a bottom part of the liquid vat.

As a concrete configuration to form more preferable ultrasonic collapse field, the configuration can be cited such that the bubble-containing-liquid inlet is located in the center of the liquid vat in a plan view, the ultrasonic collapse unit forms the ultrasonic collapse field in the center of the liquid vat in the plan view.

In order to generate nanobubbles more preferably, it is desirable that the oscillation frequency of the ultrasonic waves be set to 0.02-1.5 MHz.

As a configuration to obtain the nanobubble-containing liquid by the ultrasonic collapse unit more preferably, the configuration can be cited such that the ultrasonic collapse unit has an ultrasonic oscillator that is able to emit the ultrasonic waves, the liquid vat has an outer receptacle to which the ultrasonic oscillator is fixed and an inner receptacle that is formed inside the outer receptacle, the inner receptacle being provided with the bubble-containing-liquid inlet and the bubble-containing-liquid outlet, a medium-liquid retention area for storing medium liquid to propagate the ultrasonic waves to the inner receptacle is formed between the outer receptacle and the inner receptacle.

On the other hand, the liquid vat according to the present invention is not limited to the above structure including the outer receptacle and the inner receptacle, the liquid vat may have single structure including only the outer receptacle without using the medium liquid.

In order to form the ultrasonic collapse field more efficiently, it is desirable that the ultrasonic collapse unit have a plurality of the ultrasonic oscillators.

As a concrete configuration of the liquid vat and the ultrasonic collapse unit, the configuration can be cited such that the inner receptacle is formed into a circular shape in a plan view, the ultrasonic oscillators are radially arranged in the plan view so as to be able to emit the ultrasonic waves toward the center of the inner receptacle.

In order to obtain the nanobubble-containing liquid containing nanobubbles that have uniform diameter more efficiently, it is desirable that the ultrasonic oscillators be radially arranged so as to emit the ultrasonic waves along a direction inclined downward.

In order to obtain the nanobubble-containing liquid more efficiently without depending on kinds of gas and liquid that constitute the nanobubble-containing liquid, it is desirable that the inner receptacle have a hermetic structure to be isolated from the room air.

In order to supply microbubble-containing liquid that facilitates generating nanobubbles to the liquid vat efficiently for the sake of obtaining the nanobubble-containing liquid efficiently, it is desirable that the microbubble-containing-liquid supply unit have a gas-liquid mixer to mix liquid with gas, a microbubble generator that makes the microbubble-containing-liquid of the liquid mixed with the gas by the gas-liquid mixer, and a pump acting to discharge the microbubble-containing-liquid into the bubble-containing-liquid inlet.

Not only the gas-liquid mixer provided on an upper side from the pump in a stream of the liquid but also one provided between the pump and the microbubble generator can obtain the nanobubble-containing liquid efficiently.

As a concrete configuration of the microbubble generator, the configuration can be cited that the microbubble generator has a spin member to spin the gas-containing-liquid after passing through the gas-liquid mixer spirally, a protruding collapse member to make the gas-containing-liquid after passing through the spin member go colliding against a protrusion thereof, a stocking member to make the gas-containing-liquid after passing through the protruding collapse member convect for a certain time, and a bubbling member to bubble the gas-containing-liquid after passing through the stocking member and make the microbubble-containing-liquid of the gas-containing-liquid.

In order to obtain the microbubble-containing liquid more efficiently, it is desirable that the microbubble-containing-liquid supply unit have a pressurizer to apply pressure to the liquid in the stocking member.

In order to obtain the required amount of the nanobubble-containing liquid surely, it is desirable that the microbubble generator be modularized in an exchangeable manner.

In particular, in order to be able to cope with changing the required amount of nanobubble by a user, it is preferable that the generator be configured such that any one module can be selected from among modules having different amount of fluid flowing per a unit of time and can be mounted.

In order to supply the microbubble-containing liquid to the liquid vat efficiently, it is preferable that the microbubble-containing-liquid supply unit have a liquid-extracting path through which the liquid is extracted from the upper side of the liquid vat to the microbubble generator with the pump.

Further, in order to keep efficiency of producing the nanobubble-containing liquid high while continuous use, it is desirable that the nanobubble-producing apparatus comprises a liquid-temperature control unit to control temperature of the liquid in the liquid vat within a predetermined temperature range.

Hereinafter nanobubbles having a median particle diameter that is less than or equal to about 100 nm is referred to as "homogeneous nanobubbles". The present invention described above is characterized by converting microbubbles having diameters of about 0.2-2 μm that are mechanically generated into nanobubbles simultaneously and continuously with ultrasonic simultaneous-collapse method, the diameter of the bubbles is uniform, hence the physical characteristics of the bubbles, for example, the amount of electric charge and zeta potential, are approximately even. Thereby dispersion effect affects among the bubbles, higher concentration can be achieved, the reproducibility of washing or sterilizing effects that the bubbles show becomes very high, high throughput can be obtained. Moreover, fluorine-based resins such as vinyl chloride resin, PVDF, and PTFE, can be used for liquid contact parts, a bubble-generating system having a completely hermetic structure that has no contact with the room air can be build with resin welding, adhesion structure, and so on. Thus a secure nanobubble-generating system not limiting kinds of gas and ingredient liquid can be fabricated. Furthermore, it is possible to limit the range of particle diameter of the microbubbles to about 0.2-2 μm as well as heighten concentration, collapse the bubbles simultaneously in the ultrasonic collapse field, obtain a bubble particle diameter of about 100 nm or less and a nanobubble concentration of 300 million/ml or more. Therefore high throughput is attained by using selective adsorptive/oxidative/reductive washing/sterilizing effects with radical reactions of hydrogen/hydroxyl groups or particulate interactions between the nanobubbles and Particles (minute dust), viruses or the like, so that utilization for food washing machines without using chemicals such as hypochlorous acid, organic synthesis devices, semiconductor washing machines, sterilizing/washing machines for medical/treatment implements, and so on, is available. As a result of attaining the high throughput, ecological normal-temperature-sterilization/washing machines that are friendly to environment or human bodies can be made. In addition, another effects, for example, decomposing organic matter with ozone nanobubbles, cleaning pipes, boiler tanks or the by decomposing scale or using deodorizing effects, coating pipes and prolonging the lifetimes of the pipes by converting red rust into black rust with reducing action of hydrogen nanobubbles after cleaning, can be obtained.

Effects of the Invention

The present invention is able to provide a nanobubble-producing apparatus being capable of obtaining high-concentration nanobubbles that are minute and have a uniform diameter.

MODE FOR CARRYING OUT THE INVENTION

Described below is an embodiment of the present invention with reference to FIGS.

Figure 1:
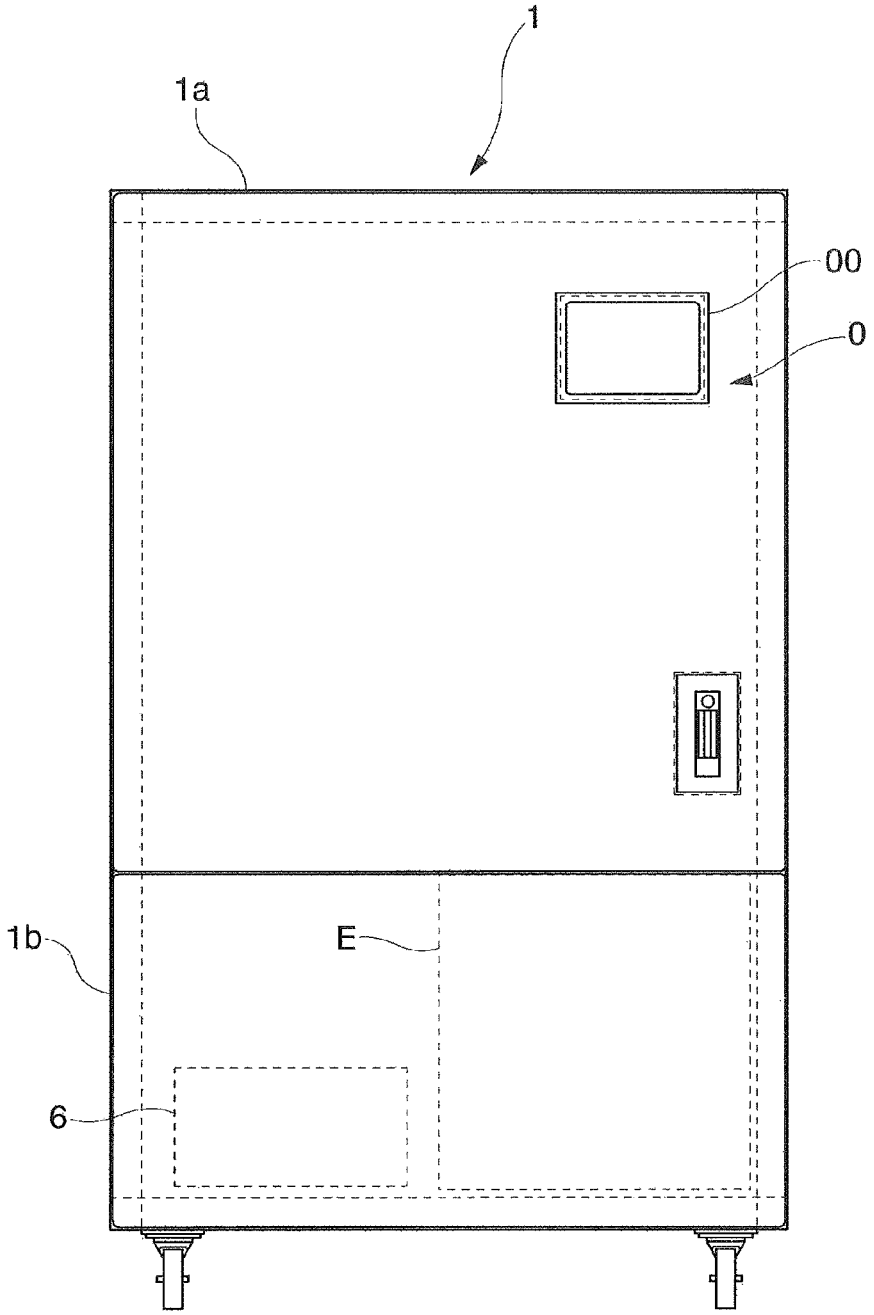
FIG. 1 is a front view of an embodiment according to the present invention.

A nanobubble-producing apparatus according to the embodiment uses ingredient liquid, for example, pure water, and generates ozone gas bubbles. That is, the nanobubble-producing apparatus is to produce nanobubble-containing liquid such that pure water contains ozone nanobubbles. FIG. 1 shows appearance of the nanobubble-producing apparatus. Most of components of the nanobubble-producing apparatus are provided in an upper part 1*a* thereof, an electric power supply device as a power source E and an ozone generator unit 6 to generate ozone gas of which bubbles are made are provided in a lower part 1*b*. An operation panel 00 of a control unit 0 is exposed in a top area on a front face of a cabinet 1 of the nanobubble-producing apparatus so that a user can arbitrarily operate this nanobubble-producing apparatus with the operation panel 00.

The nanobubble-producing apparatus according to the embodiment is characterized by comprising a liquid vat 2 provided with an inlet 21*a* as a bubble-containing-liquid inlet in an upper part thereof and an outlet 21*b* as a bubble-containing-liquid outlet in a bottom part thereof, a microbubble-containing-liquid supply unit 3 to supply microbubble-containing liquid MB that contains microbubbles to the inlet 21*a* of the liquid vat 2, an ultrasonic collapse unit 4 to radiate ultrasonic waves ss to the inside of the liquid vat 2 so that an ultrasonic collapse field X in which the collapsing of the microbubbles with the ultrasonic waves ss is concentrated and nanobubbles are generated is formed at a location where the microbubble-containing liquid MB supplied into the liquid vat 2 through the inlet 21*a* flows downward, and a nanobubble-containing-liquid extraction portion 5 where nanobubble-containing liquid NB that contains the nanobubbles generated by the ultrasonic collapse unit 4 is taken out of the liquid vat 2 through the outlet 21*b*.

Figure 2:
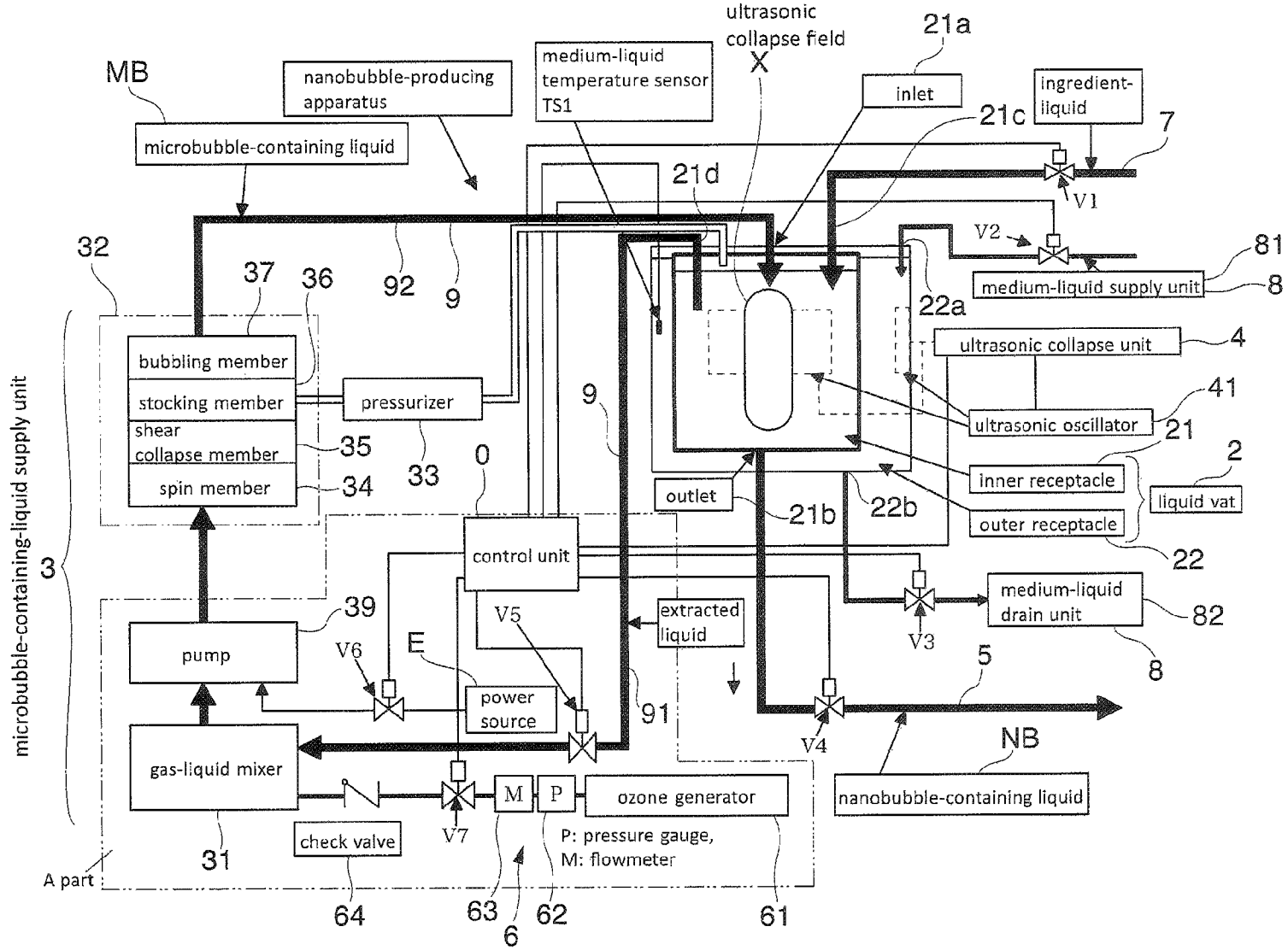
FIG. 2 is a functional block diagram of the embodiment.
Figure 3:
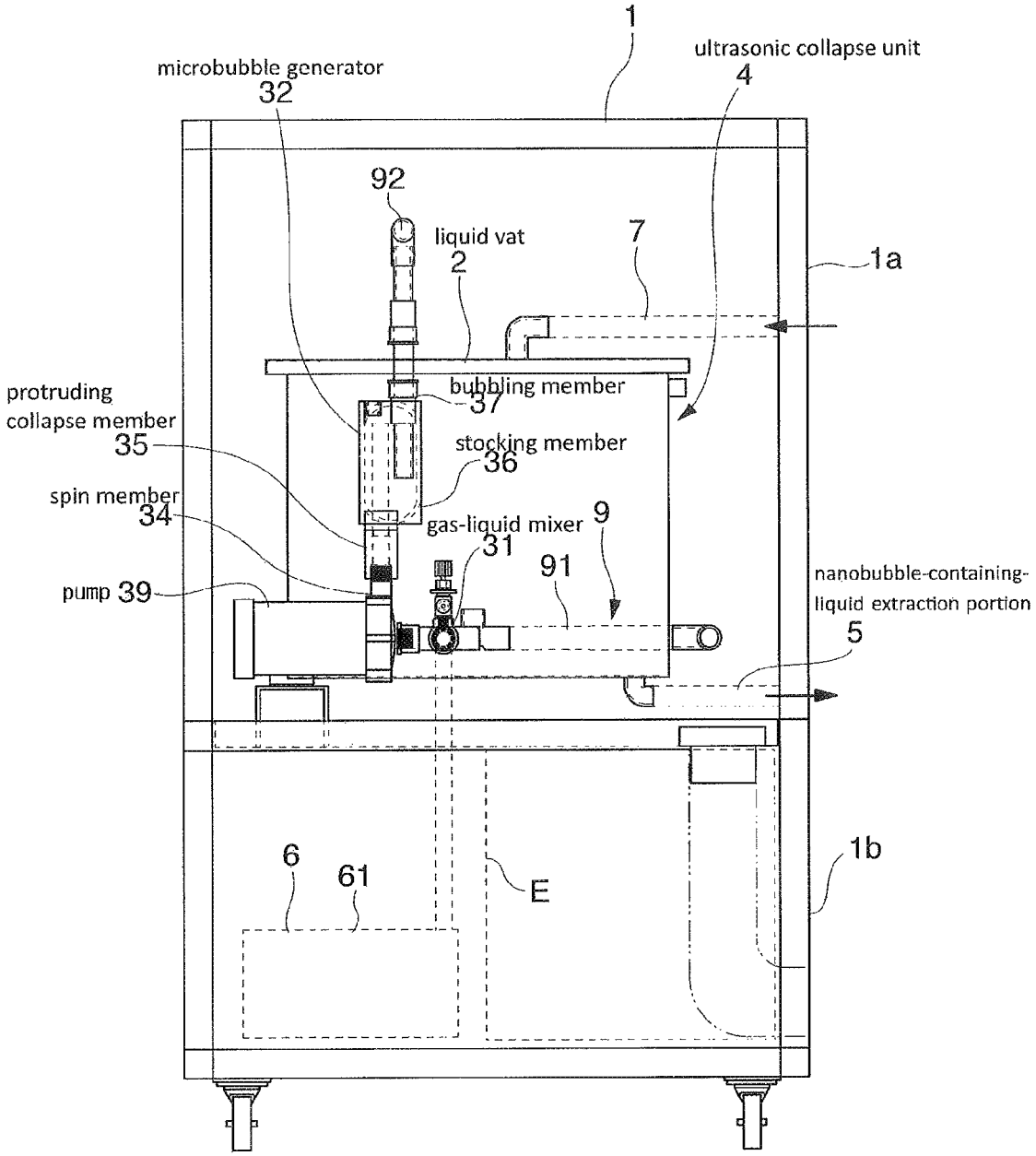
FIG. 3 is an explanatory diagram of an arrangement of the embodiment viewed from the front.
Figure 4:
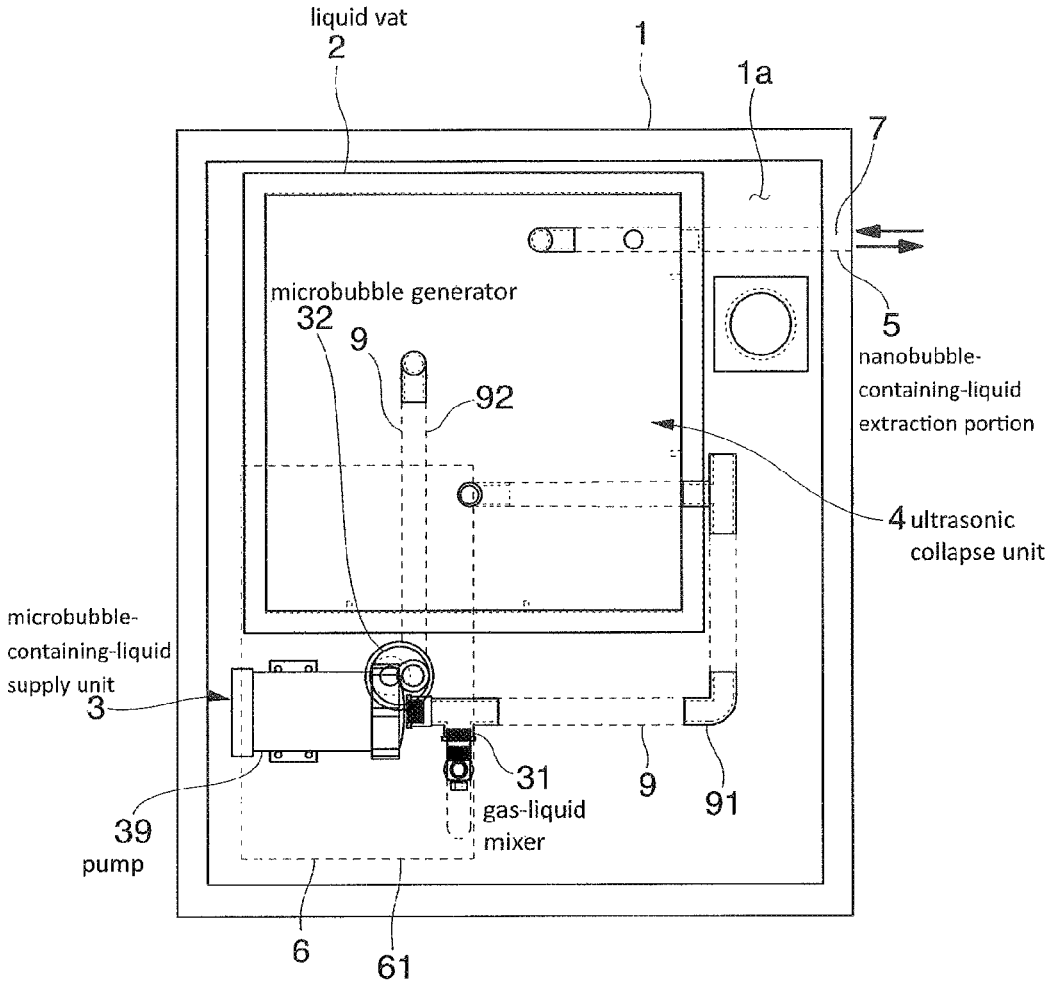
FIG. 4 is an explanatory diagram of the arrangement viewed from the top.
Figure 5:
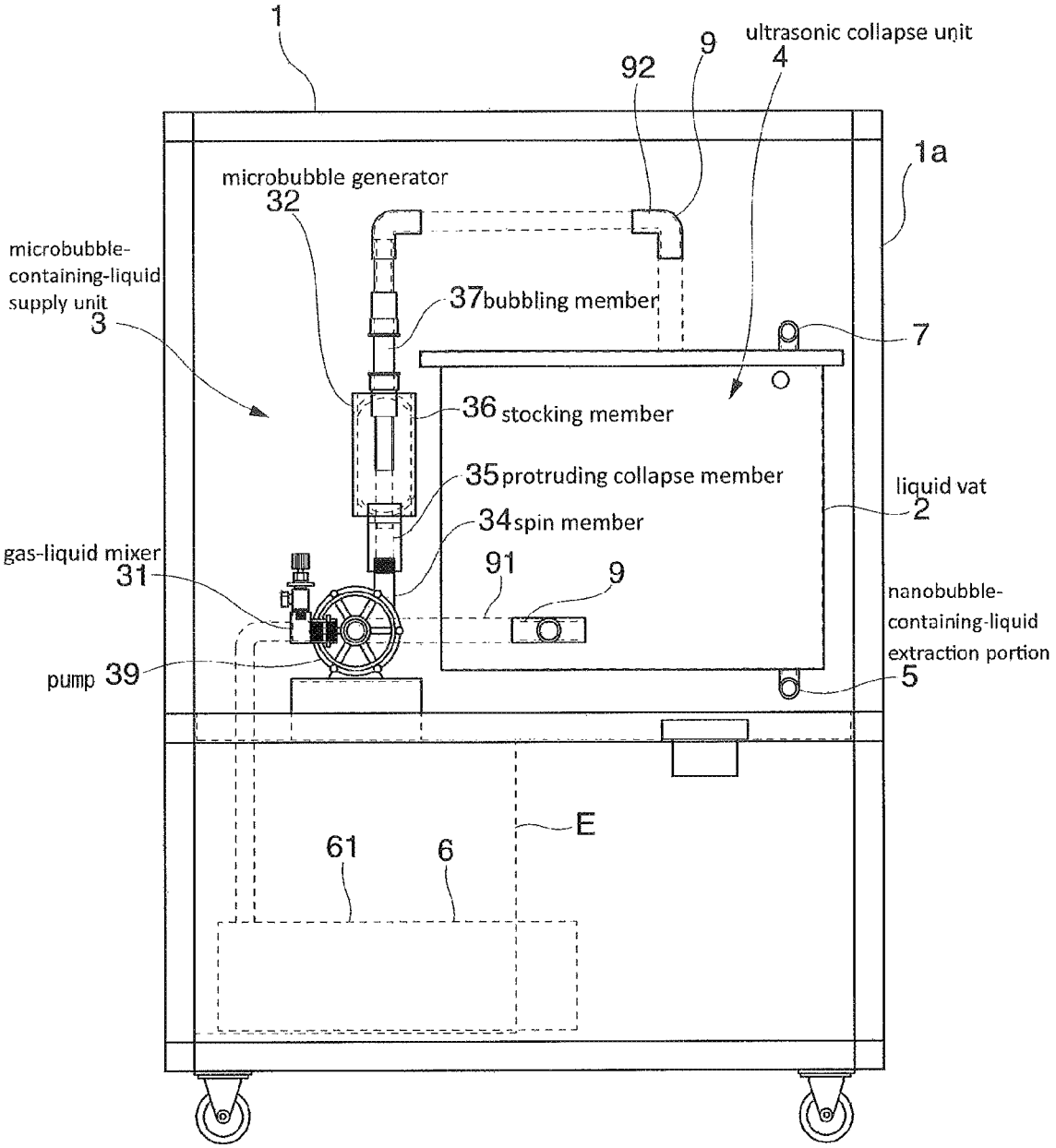
FIG. 5 is an explanatory diagram of the arrangement viewed from the right.

<Exposition of Configurations> Configurations of the nanobubble-producing apparatus will be expounded with reference to FIGS. 2-9. FIGS. 3-5 mainly illustrates arrangement of the liquid vat 2, the microbubble-containing-liquid supply unit 3, and the ultrasonic collapse unit 4 in the cabinet 1. As shown in FIG. 2, the nanobubble-producing apparatus includes an ingredient-liquid-introducing portion 7 to introduce the ingredient liquid such as pure water, the liquid vat 2 to store the ingredient liquid from the ingredient-liquid-introducing portion 7, the microbubble-containing-liquid supply unit 3 to which a liquid-circulation system 9 connects the liquid vat 2, the ozone generator unit 6 connected to the microbubble-containing-liquid supply unit 3, the ultrasonic collapse unit 4 provided on the liquid vat 2, the nanobubble-containing-liquid extraction portion 5 to extract the nanobubble-containing liquid NB produced in the liquid vat 2, and a medium-liquid passage 8 to guide medium liquid that is introduced into or drained from the liquid vat 2 separately from the ingredient liquid. Also, valves V1-V4, V6, V7 and a switch V5 are provided in various places inside the nanobubble-producing apparatus, the valves V1-V4, V6, V7 and the switch V5 are controlled by the control unit 0. According to the embodiment, a liquid-extracting path 91 through which the microbubble-containing-liquid supply unit 3 extracts the liquid from the upper side of the liquid vat 2 to a microbubble generator with a pump 39 is provided. This liquid-extracting path 91 and a supplying path 92 that lies between the microbubble-containing-liquid supply unit 3 and the liquid vat 2 constitutes the liquid-circulation system 9 being capable of circulating the liquid.

The ingredient-liquid-introducing portion 7 is to introduce pure water as an example of the ingredient liquid generated outside the apparatus into the liquid vat 2. The valve V1 that is opened/closed by the control unit 0 is provided on the ingredient-liquid-introducing portion 7.

The nanobubble-containing-liquid extraction portion 5 is to extract the nanobubble-containing liquid NB produced with the ultrasonic collapse unit 4 from the liquid vat 2 to the outside of the apparatus through the outlet 21*b*. The valve V4 that is opened/closed by the control unit 0 is provided on the nanobubble-containing-liquid extraction portion 5.

The ozone generator unit 6 has an ozone generator 61 to generate ozone, a pressure gauge 62, a flowmeter 63 and a check valve 64, the pressure gauge 62, the flowmeter 63 and the check valve 64 are provided on a passage from the ozone generator 61 to the microbubble-containing-liquid supply unit 3. An existing device to generate ozone of which the bubbles are made is adopted as the ozone generator 61. Of course, the nanobubble-producing apparatus can produce nanobubble-containing liquid NB that contains other gases such as oxygen, nitrogen, ammonia, hydrogen, or carbon dioxide by being equipped with different existing devices instead of the ozone generator 61. The valve V7 that is opened/closed by the control unit 0 is provided on the ozone generator unit 6.

Figure 8:
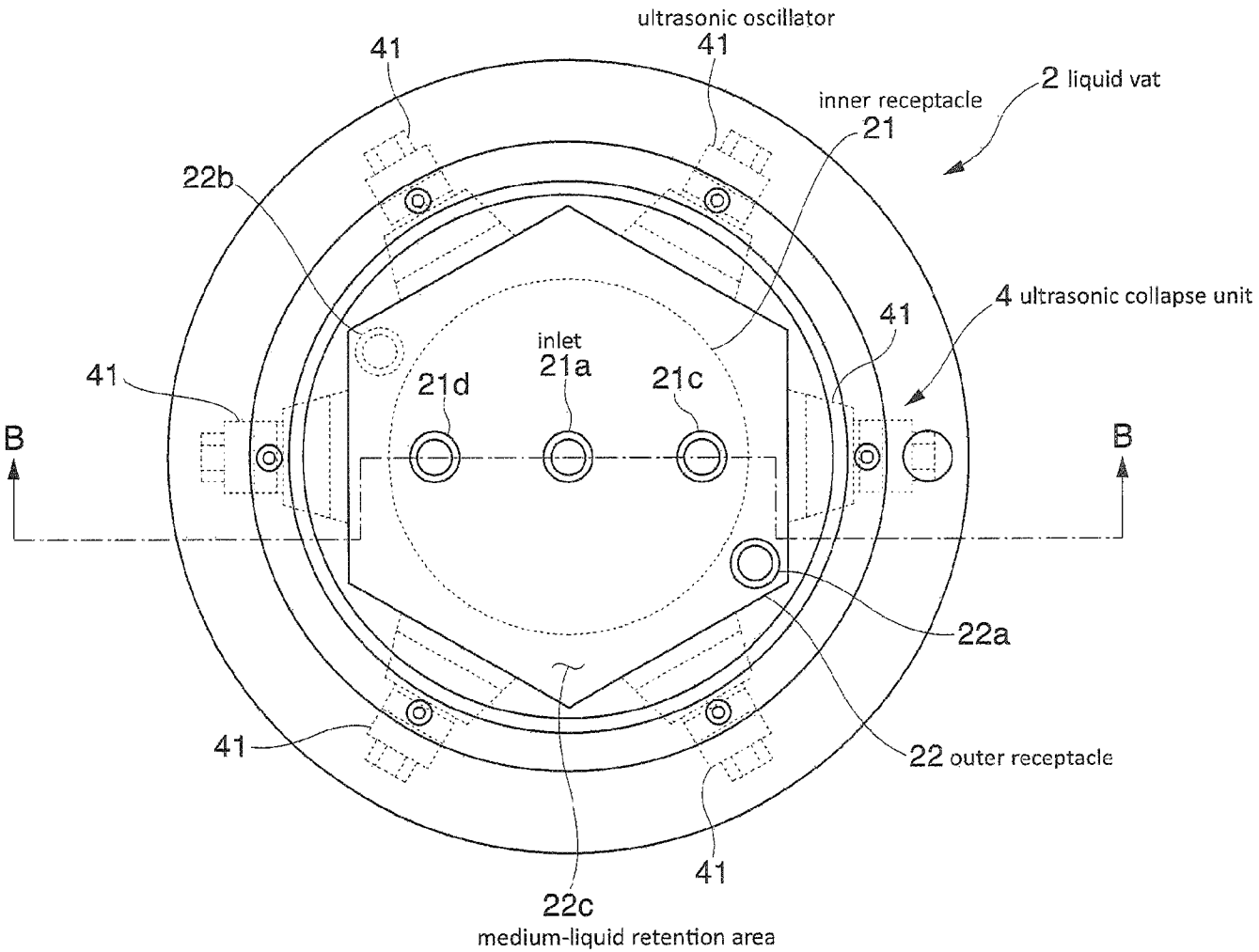
FIG. 8 is a plan view of an ultrasonic collapse unit of the embodiment.
Figure 9:
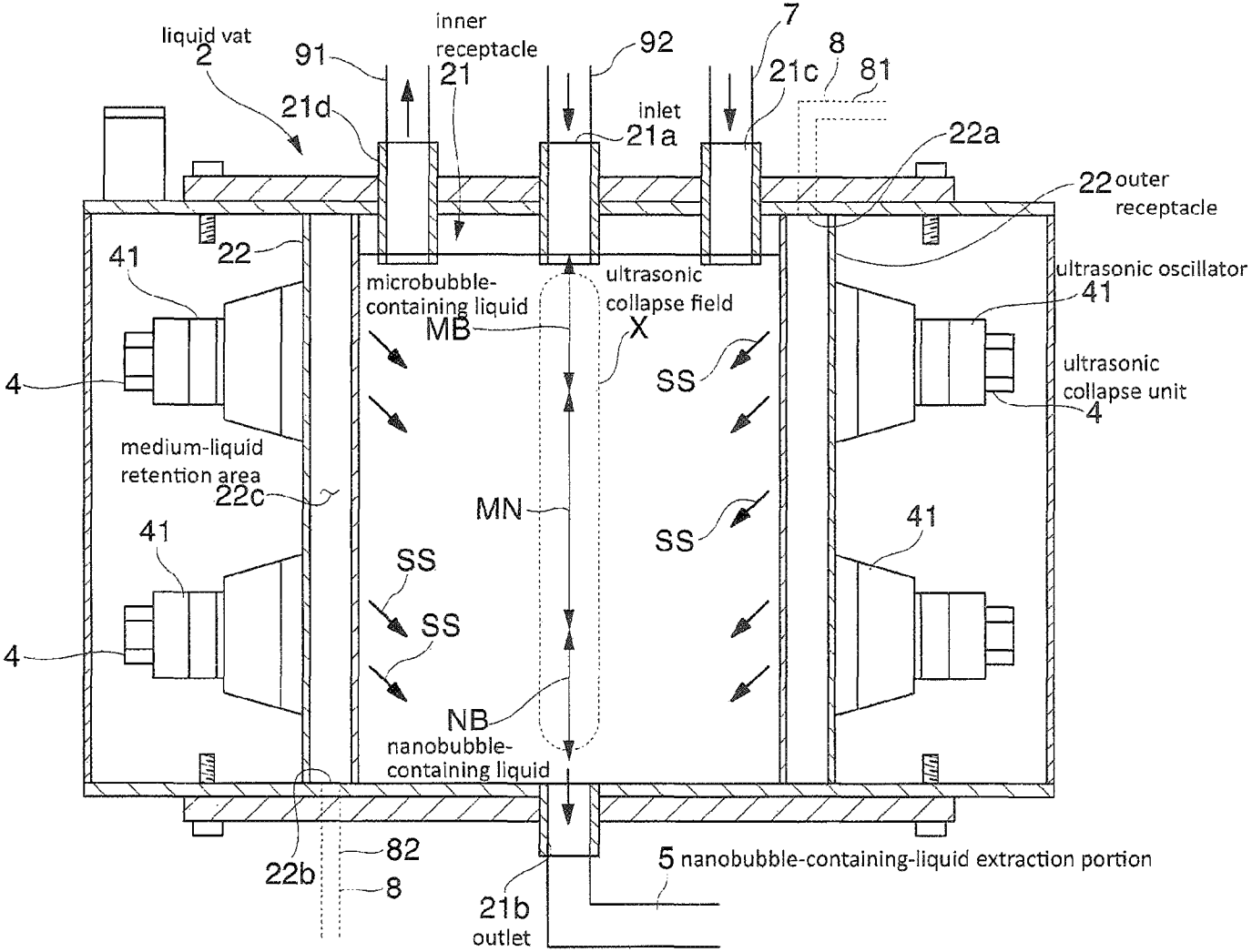
FIG. 9 is an explanatory diagram of the essential part of the arrangement based on a cross section taken along the line B-B.

As shown in FIGS. 2, 8 and 9, the liquid vat 2 comprises mainly an outer receptacle 22 and an inner receptacle 21, the outer receptacle 22 and the inner receptacle 21 make double-layer structure. The inner receptacle 21 is formed into a circular shape in a plan view, the inner receptacle 21 has a hermetic structure to be isolated from the room air. The inlet 21*a* as the bubble-containing-liquid inlet, an ingredient-liquid inlet 21*c* to which the ingredient liquid is supplied from an ingredient-liquid supply unit, and a liquid-extracting outlet 21*d* to extract the liquid that exists in an upper layer (a part higher than a height of three-quarters of the depth of the receptacle from the bottom) of the inner receptacle 21 are provided in an upper part of the inner receptacle 21. The outlet 21*b* to extract the nanobubble-containing liquid NB to the outside of the apparatus with the nanobubble-containing-liquid extraction portion 5 is provided in a bottom part, namely, a bottom face of the inner receptacle 21. The outer receptacle 22 is formed into a hexagonal shape in the plan view, the outer receptacle 22 is made of material that can reflect the ultrasonic waves ss, for example, stainless steel. The outer receptacle 22 has a medium-liquid inlet 22*a* to which the medium liquid is supplied in an upper part thereof, and a medium-liquid-draining outlet 22*b* to drain the medium liquid in a bottom part thereof. A medium-liquid retention area 22*c* for storing the medium liquid to propagate the ultrasonic waves ss to the inner receptacle 21 is formed between the outer receptacle 22 and the inner receptacle 21.

The material of the inner receptacle 21 will be described in detail. It is desirable that the inner receptacle 21 be made of resin materials, namely, fluorine-based resins such as vinyl chloride resin or PVDF, or quartz. For resin materials, the upper part is made into a completely hermetic structure by resin welding, adhesion or the like. For quartz, a hermetic structure is to be fabricated with sealing materials such as PTFE, Viton or the like. The reason is that those are ways to prevent a minute amount of gas generated in ultrasonic collapsing of the microbubbles from contacting the room air. When ozone nanobubbles are generated, it is for preventing the danger to human bodies by ozone leakage. When hydrogen nanobubbles are generated, it is for preventing the danger of explosion by contact of hydrogen with oxygen. In addition, such measures prevent contamination with aerial gases in organic synthesis reactions with the bubbles and make it possible to obtain stable organic synthesis reactions.

The medium-liquid passage 8, together with a temperature sensor TS1 provided in the outer receptacle 22, functions as a liquid-temperature control unit to control temperature of the liquid in the liquid vat 2 within a predetermined temperature range. The medium-liquid passage 8 includes a medium-liquid supply unit 81 to supply the medium liquid from the outside of the apparatus to the medium-liquid inlet 22*a* of the outer receptacle 22, and a medium-liquid drain unit 82 to drain the medium liquid from the medium-liquid-draining outlet 22*b* of the outer receptacle 22 to the outside of the apparatus. The valve V2 is provided on the medium-liquid supply unit 81, the valve V3 is provided on the medium-liquid drain unit 82, these valves V2 and V3 are controlled by the control unit 0.

Figure 6:
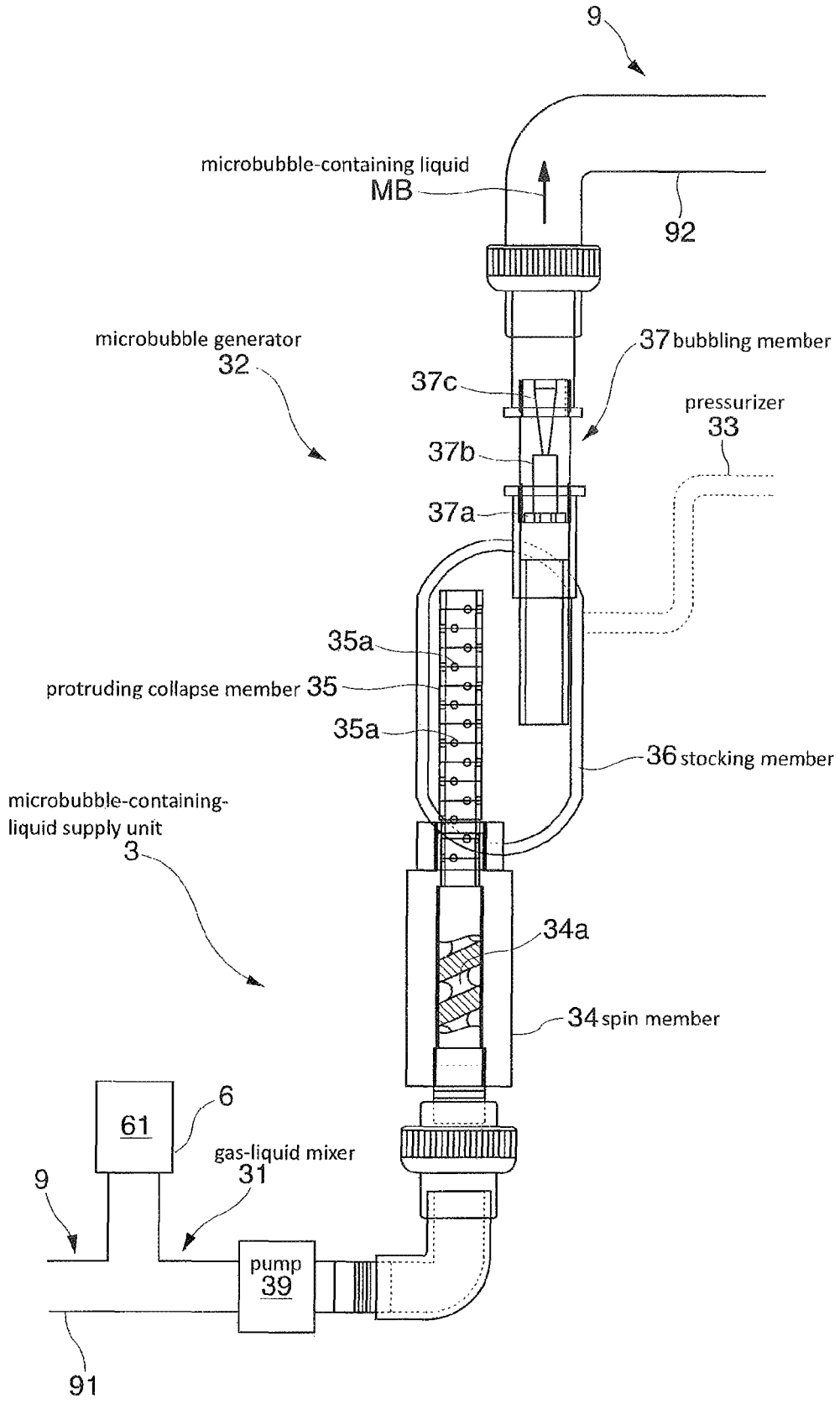
FIG. 6 is a diagram of an arrangement of a microbubble generator of the embodiment.
Figure 7:
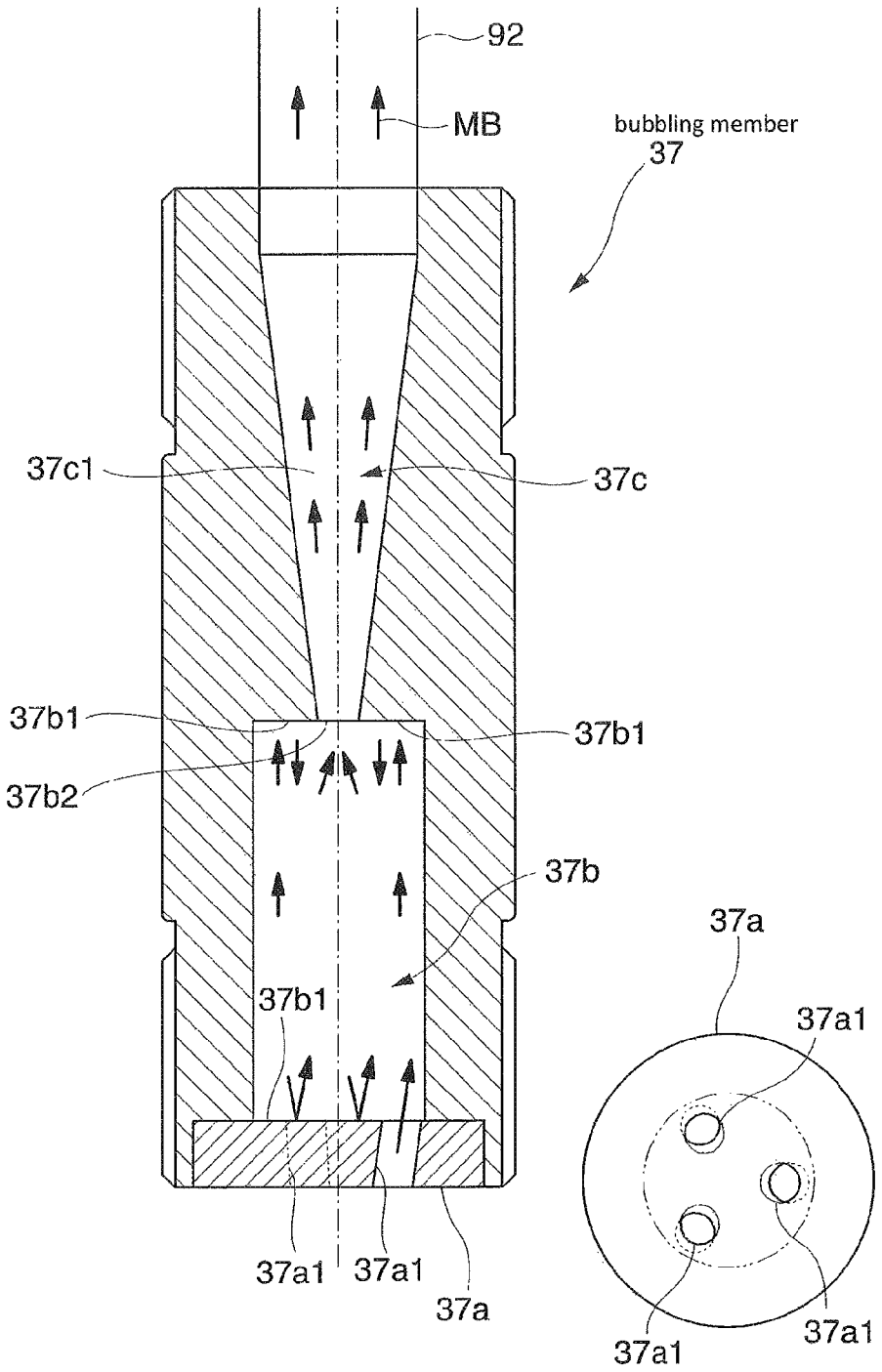
FIG. 7 is a partly enlarged view of FIG. 6.

As shown in FIGS. 2, 6 and 7, the microbubble-containing-liquid supply unit 3 is to supply the microbubble-containing liquid MB containing the microbubbles to the bubble-containing-liquid inlet of the liquid vat 2 through the supplying path 92. The microbubble-containing-liquid supply unit has a gas-liquid mixer 31 to mix the liquid with the gas, the microbubble generator 32 that makes the microbubble-containing-liquid MB of the liquid mixed with the gas by the gas-liquid mixer 31, and the pump 39 acting to discharge the microbubble-containing-liquid MB into the inlet 21*a*. Since an existing pump is adopted as the pump 39, the description thereof is omitted. For example, an air-driven positive-displacement pump is used as the pump 39. However, the type of the pump 39 is not limited, a non-positive-displacement pump such as a magnet pump and an axial pump may be employed.

According to this embodiment, the gas-liquid mixer 31 is provided on an upper side from the pump 39 in a stream of the liquid, a gas inlet of the gas-liquid mixer 31 is provided in the neighborhood of a suction port of the pump 39 so that the liquid and the gas are simultaneously sucked by using suction force of the pump 39, and besides bubble-containing liquid that is a gas-liquid mixture is produced in the pump 39. The reason for employing the above configurations is that the object is to smoothly mix the liquid with the gas along the direction of flowing of the liquid. If its position were against the direction of flowing of the liquid, owing to being affected directly by variation in pressure of the liquid, the flow rate of the gas that flows in would not be constant, and besides it would be impossible to smoothly mix the liquid with the gas, as a result, the phenomenon such that a large quantity of the gas races the pump 39 or the phenomenon such that the generating of bubbles is irregular because of the shortage of the gas would occur. On the contrary, according to the embodiment, introduction amount of the gas is constant only by supplying the gas with constant introduction pressure, the introduction amount of the gas can be continuously stabilized.

The microbubble generator 32 has a spin member 34 to spin the gas-containing-liquid after passing through the gas-liquid mixer 31 spirally, a protruding collapse member 35 to make the gas-containing-liquid after passing through the spin member 34 go colliding against protrusions 35*a* thereof, a stocking member 36 to make the gas-containing-liquid after passing through the protruding collapse member 35 convect for a certain time, and a bubbling member 37 to bubble the gas-containing-liquid after passing through the stocking member 36 and make the microbubble-containing-liquid MB of the gas-containing-liquid. According to the embodiment, the microbubble generator 32 is modularized in an exchangeable manner. More specifically, the microbubble generator 32 is configured such that any one module can be selected from among modules having different amount of fluid flowing per a unit of time and can be mounted. Another microbubble generator 32 as a variation configured to have different amount of fluid flowing will be described in detail later.

The spin member 34 lets the liquid flow along a spin face 34*a* that is formed into a spiral shape inside. It is desirable that the spin member 34 make it rotate about an axis by at least 1.5 turns. Imparting swirling action with discharge pressure of the pump 39 to the gas-containing-liquid mixed in the gas-liquid mixer 31 can accelerate flow velocity. As speed of rotation around the axis increases, the flow velocity increases, but pressure drop increases to that extent. Therefore optimum rotation speed is determined from the lift of the pump 39 and requested concentration of the bubbles. The spin member 34 is not for swirling flow that consisting only of liquid as disclosed in Patent document 1, but characterized by being used as a means to accelerate the flow velocity of the gas-containing-liquid. Hence, microbubbles is not generated in this portion.

The protruding collapse member 35 is placed at the stage following the spin member 34. The protruding collapse member 35 has a role of increasing concentration of the bubbles by shearing and collapsing the gas-containing-liquid that has passed through the spin member 34 with the protrusions 35*a*. The protruding collapse member 35 has a cylindrical structure and is provided with many protrusions 35*a* that are arranged along a direction perpendicular to a circumferential direction so that tops of the protrusions 35*a* are opposed to each other, the central part of the protruding collapse member 35 becomes a fluid passage that is a cavity where the protrusions 35*a* does not exist. The number of rungs of the protrusions 35*a* is at least six steps, the protrusions 35*a* are alternately arranged by thirty-six or more degrees in the longitudinal direction. In addition, the protruding collapse member 35 is continuous with the spin member 34 and integrally formed. The gas-containing-liquid accelerated in the spin member 34 collides against the protrusions 35*a* and is crushed, the bubbles are further fragmented. Resin welding is employed in this embodiment, however, the protrusions 35*a* may be configured to be screwed. Unlike in the arrangement in FIGS., the protrusions 35*a* may be positioned in four directions by ninety degrees or in six directions by sixty degrees. The reason for separating the protrusions 35*a* each by thirty-six degrees in the embodiment is that, if the protrusions 35*a* were arranged in series, the protrusions 35*a* in front could shear and collapse the gas-containing-liquid, but the protrusions 35*a* in following steps would hide behind the front ones and could not perform those roles. Therefore the angles of the protrusions 35*a* in front are shifted, and the protrusions 35*a* placed in the following steps can consequently shear and collapse in the same way. The above arrangement can make space behind the protrusions 35*a* and obtain shearing and collapsing effect through colliding of the fluid along the flowing direction against Kármán's vortexes generated behind the protrusions 35*a* (the Kármán's vortexes generated behind the protrusions 35*a* are explained in Kouzou Sudo et al. *Mechanics of Fluids*, CORONA PUBLISHING CO., LTD, 1994, pp. 196).

The stocking member 36 is to temporarily store the gas-containing-liquid being the liquid that has passed through the protruding collapse member 35. For example, the stocking member 36 can store an amount of ⅕-1/20 of discharge amount per minute of the pump 36. The stocking member 36 accommodates a downstream side end part of the protruding collapse member 35 and an upstream side end part of the bubbling member 37.

As shown especially in FIG. 7, the bubbling member 37 has a slit plate 37*a* that contains, for example, a plurality of offset holes 37*a*1, a re-pressurization part 37*b* formed into a cylindrical shape to pressurize the liquid, and a taper part 37*c* formed into a tapered conic structure. The slit plate 37*a* includes, for example, tree offset holes 37*a*1 that are provided at positions displaced from the center and constitute an equilateral triangle. Also, these offset holes 37*a*1 are bored such that the offset holes 37*a*1 are inclined by predetermined degrees relatively with respect to the passage of the liquid and extended in radiating directions. The re-pressurization part 37*b* contains an exit hole 37*b*2 through which the liquid flows out, and impingement walls 37*b*1 that are placed around the exit hole 37*b*2 and in the back of the slit plate 37*a*, the exit hole 37*b*2 having a smaller open area than open areas of the offset holes 37*a*1 so as to pressurize the gas-containing-liquid being the liquid that has passed through the offset holes 37*a*1 inside. The taper part 37*c* contains a taper face 37*c*1 expanding like a cone with an apex angle that is smaller than, for example, fifteen degrees. In such configurations, the liquid that has passed through the offset holes 37*a*1 flows along inclined directions and is pressurized, and besides the bubbles are further collapsed owing to impingement of the liquid against the impingement walls 37*b*1 in front and behind. After that, the liquid arrives in the taper part 37*c* through the exit hole 37*b*2 and is decompressed rapidly, thereby the gas-containing-liquid is changed into the microbubble-containing liquid MB. More specifically, the pressure in the re-pressurization part 37*b* is about 3 MPa, meanwhile the pressure in the taper part 37*c* is drastically decompressed to 1 MPa, and consequently the liquid that has passed through the bubbling member 37 becomes the microbubble-containing liquid MB that contains uniform microbubbles.

In particular, through the rapid decompression with the bubbling member 37, it is possible to provide micronized and uniform microbubbles using not stainless steel but resins such as PVDF, PTFE, and PVC, that was considered impossible in known prior arts. Here, known venturi tubes cannot achieve the re-pressurization effect as described above.

On top of that, according to the embodiment, the microbubble-containing-liquid supply unit 3 has a pressurizer 33 to ensure the faculty of increasing concentration of the bubbles by heightening the pressure in the stocking member 36 to a predetermined value (about 0.8-2 MPa) in addition to the above gas-liquid mixer 31, the microbubble generator 32 and the pump 39. This pressurizer 33, which is one of the most important functions according to the present invention to atomize and uniformize the microbubbles, functions to raise the pressure in the stocking member 36 to the predetermined value (about 0.8-2 MPa) so as to increase concentration of the bubbles and uniformize the amount of electric charge and zeta potential of the bubbles sheared and collapsed by utilizing convection for a certain time and pressurizing-compression effect with a surplus of the gas. These mechanisms make it possible to generate super-high-concentration nanobubbles that are minute and have a uniform diameter even using the pump 39 whose lift is low, for example, a positive displacement pump (air-driven bellows pump, air-driven diaphragm pump, and so on). Moreover, it is possible to further increase the concentration using a non-positive-displacement pump (magnet pump, axial pump, and so on) because the lift of such a pump is higher. Hence, the microbubble-containing-liquid supply unit 3 not limiting kinds of the pump 39 can be fabricated through the above function. The gas-containing liquid pressurized in the stocking member 36 by the pressurizer 33 is pressurized again in the re-pressurization part 37*b* of the bubbling member 37.

The ultrasonic collapse unit 4 has a plurality of the ultrasonic oscillators 41 that are mounted on the outer receptacle 22. According to the embodiment, six ultrasonic oscillators 41 are radially attached to the outer receptacle 22 formed into the hexagonal shape in the plan view each. That is, the ultrasonic oscillators 41 are arranged so as to be able to emit the ultrasonic waves ss toward the center of the inner receptacle 21. The oscillation frequency of the ultrasonic waves ss by the ultrasonic collapse unit 4 is set to 0.02-1.5 MHz, especially to 0.028-1.5 MHz. Also, the six ultrasonic oscillators 41 are provided so as to emit the ultrasonic waves ss along directions inclined downward, for example, directions inclined downward by about fifteen degrees.

<Exposition of Workings> According to the nanobubble-producing apparatus of this embodiment, in the center of the inner receptacle 21 in the plan view, the ultrasonic collapse field X in which the collapsing of the microbubbles with the ultrasonic waves ss is concentrated and the nanobubbles are generated is formed at the location where the microbubble-containing liquid MB supplied into the liquid vat 2 through the bubble-containing-liquid inlet flows downward. More specifically, this apparatus is configured such that energy of the ultrasonic waves propagated from the ultrasonic oscillators 41 is reflected by walls such as stainless steel panels of the outer receptacle 22, the ultrasonic collapse field X coupled with the reflected energy is formed in the inner receptacle 21. In other words, the ultrasonic collapse unit 4 concentrates the ultrasonic waves ss on a prismatic or columnar central region, namely, the ultrasonic collapse field X in the liquid vat 2, and collapses the microbubbles catching them in a trap with the ultrasonic waves ss. This apparatus is characterized in that the nanobubbles are generated by the above. Hence, the ideal nanobubble-containing liquid NB with a particle diameter of about 100 nm or less and a nanobubble concentration of 300 million/ml or more can be produced by selecting the energy amount and frequency of the ultrasonic waves ss appropriately.

On the other hand, with respect to techniques to obtain nanobubbles afresh with ultrasonic waves, studies regarding the generation and mechanisms of nanobubbles conventionally have been existed, however, concentration of the nanobubbles was low and could not be increased, those bubbles had a short lifetime (Mizuki Goto, *Studies Regarding the Generation and Mechanisms of Nanobubbles*, a master's thesis for Graduate School of Systems and Information Engineering, University of Tsukuba, 2004). Also, methods to obtain nanobubbles of microbubbles with collapsing as described in Japanese Unexamined Patent Application Publications No. 2005-246293 and No. 2011-218308 have been invented. The former Publication only discloses applying ultrasonic waves simply, applying physical stimulus using an orifice-structure porous plate, applying physical stimulus of voltage, and explains that nanobubbles with diameters of 500 nm or less could not be atomized beyond that using the Young-Laplace equation. In addition, the latter Publication No. 2011-218308 and so on discloses designed methods such that ultrasonic waves are applied upward from bottom faces of chambers, however, these methods could not generate high-concentration nanobubbles because microbubbles and nanobubbles moved with vibrational energy to the opposite side in the applying direction of the ultrasonic waves.

<Exposition of Operations> The operation flow of the nanobubble-producing apparatus according to the embodiment will be expounded.

First, the user input a command to start operation with the operation panel 00 exposed in the cabinet 1, thereby the valve V2 is opened, the medium liquid is supplied to the outer receptacle 22. Supplying of the medium liquid continues until a sensor, which is not illustrated, detects the fact that the amount of the medium liquid reaches a certain amount in the medium-liquid retention area 22*c* of the outer receptacle 22. When the amount of the medium liquid reaches the certain amount, the control unit 0 commands the valve V2 to be closed, the valve V2 is closed so as to stop supplying the medium liquid. Also, the control unit 0 verifying that the amount of the liquid in the inner receptacle 21 does not reaches an enough amount with a water level sensor in the inner receptacle 21, which is not illustrated, opens the valve V1 to start supplying the ingredient liquid from the ingredient-liquid-introducing portion 7. Supplying of the ingredient liquid continues until the water level sensor detects the fact that the amount of the ingredient liquid in the inner receptacle 21 is the maximum. In other words, when the water level sensor detects the fact that the inner receptacle 21 stores an enough amount of the ingredient liquid, the control unit 0 commands the valve V1 to be closed so as to stop supplying the ingredient liquid.

Thereafter the control unit 0 commands the switch V5 to be opened, the pump 39 starts its action. According to the embodiment, for example, an air-driven positive-displacement pump is used as the pump 39. However, if an axial pump or a magnet pump is used, a relay or the like may be turn on so as to start supplying electric power to the electrically-driven pump. At this time, the valves V6 is kept closed for a predetermined period, ozone gas of which bubbles are made is not supplied to gas-liquid mixer 31, idling operation is performed. The length of the idling is preset to an appropriate value by the control unit 0. After the preset idling period is elapsed, the control unit 0 commands the valve V6 to be opened so as to supply ozone to the gas-liquid mixer 31. The ozone is supplied to the pump 39 via the gas-liquid mixer 31, goes through the microbubble generator 32 to produce the microbubble-containing liquid MB, and is converted into the nanobubble-containing liquid NB in the liquid vat 2 by the ultrasonic collapse unit 4.

Inside the liquid vat 2, the upper layer of the inner receptacle 21 becomes a region that the microbubble-containing liquid MB occupies, the middle layer thereof becomes a region that liquid containing a mixture of the microbubbles and the nanobubbles MN occupies, and the lower layer thereof becomes a region that the nanobubble-containing liquid NB occupies. It is possible to heighten concentration of the nanobubbles from the lower layer through repetition of such movement. That is, the concentration of the nanobubbles in the nanobubble-containing liquid NB generated in the lower layer of the inner receptacle 21 is gradually increased by circulating the liquid between the inner receptacle 21 and the microbubble-containing-liquid supply unit 3 with the liquid-circulation system 9 in operation.

The user can extract an intended amount of the nanobubble-containing liquid NB from the nanobubble-containing liquid NB generated in the lower layer of the inner receptacle 21 through the nanobubble-containing-liquid extraction portion 5 by manipulating the operation panel 00 and opening the valve V4.

In continuous operation, the temperature of the medium liquid in the medium-liquid retention area 22*c* gradually rises owing to applying the ultrasonic waves ss to the medium liquid continuously. The temperature sensor TS1 measures the temperature. When the temperature of the medium liquid measured by the temperature sensor TS1 reaches predetermined degrees, the control unit 0 opens the valve V3 to drain a part of the medium liquid and opens the valve V2 to replace the part of the medium liquid so that temperature rising of the medium liquid is suppressed. Needless to say, the temperature of supplied medium liquid is within a range suitable for use.

With such configurations as described above, the nanobubble-producing apparatus according to the embodiment can obtain the nanobubble-containing liquid NB containing high-concentration nanobubbles that are minute and have a uniform diameter. More specifically, the microbubble-containing-liquid supply unit 3 produces the microbubble-containing liquid MB that contains the bubbles with diameters of about 0.2-2 μm, the ultrasonic collapse field X formed as shown in FIG. 9 causes further collapse of the microbubble-containing liquid MB, and the homogeneous-nanobubble-producing apparatus that can achieve a bubble particle diameter of about 100 nm or less and a nanobubble concentration of 300 million/ml or more is consequently fabricated.

According to the embodiment, as a concrete configuration to form more preferable ultrasonic collapse field X, the configuration is employed such that the inlet 21*a* is located in the center of the liquid vat 2 in the plan view, the ultrasonic collapse unit 4 forms the ultrasonic collapse field X in the center of the liquid vat 2 in the plan view.

According to the embodiment, in order to generate nanobubbles more preferably, the oscillation frequency of the ultrasonic waves is set to 0.02-1.5 MHz According to the embodiment, as a configuration to obtain the nanobubble-containing liquid NB by the ultrasonic collapse unit 4 more preferably, the configuration is employed such that the ultrasonic collapse unit 4 has the ultrasonic oscillators 41 that are able to emit the ultrasonic waves, the liquid vat 2 has the outer receptacle to which the ultrasonic oscillators 41 are fixed and the inner receptacle 21 that is formed inside the outer receptacle 22, the inner receptacle 21 being provided with the bubble-containing-liquid and the outlet 21*b*, the medium-liquid retention area 22*c* for storing the medium liquid to propagate the ultrasonic waves to the inner receptacle 21 is formed between the outer receptacle 22 and the inner receptacle 21.

According to the embodiment, in order to form the ultrasonic collapse field X more efficiently, the ultrasonic collapse unit 4 has a plurality of the ultrasonic oscillators 41.

According to the embodiment, as a concrete configuration of the liquid vat 2 and the ultrasonic collapse unit 4, the configuration is employed such that the inner receptacle 21 is formed into a circular shape in the plan view, the ultrasonic oscillators 41 are radially arranged in the plan view so as to be able to emit the ultrasonic waves toward the center of the inner receptacle 21.

According to the embodiment, in order to obtain the nanobubble-containing liquid NB containing the nanobubbles that have uniform diameter more efficiently, the ultrasonic oscillators 41 are radially arranged so as to emit the ultrasonic waves along directions inclined downward.

According to the embodiment, in order to obtain the nanobubble-containing liquid NB more efficiently without depending on kinds of gas and liquid that constitute the nanobubble-containing liquid NB, the inner receptacle 21 have a hermetic structure to be isolated from the room air.

According to the embodiment, in order to supply the microbubble-containing liquid MB that facilitates generating the nanobubbles to the liquid vat 2 efficiently for the sake of obtaining the nanobubble-containing liquid NB efficiently, the mode is employed such that the microbubble-containing-liquid supply unit 3 has the gas-liquid mixer 31 to mix liquid with gas, the microbubble generator 32 that makes the microbubble-containing-liquid MB of the liquid mixed with the gas by the gas-liquid mixer 31, and the pump 39 acting to discharge the microbubble-containing-liquid MB into the inlet 21*a*.

According to the embodiment, as a concrete configuration of the microbubble generator 32 with higher performance, the configuration is employed that the microbubble generator 32 has the spin member 34 to spin the gas-containing-liquid after passing through the gas-liquid mixer 31 spirally, the protruding collapse member 35 to make the gas-containing-liquid after passing through the spin member 34 go colliding against the protrusions 35*a* thereof, the stocking member 36 to make the gas-containing-liquid after passing through the protruding collapse member 35 convect for a certain time, and the bubbling member 37 to bubble the gas-containing-liquid after passing through the stocking member 36 and make the microbubble-containing-liquid MB of the gas-containing-liquid.

In particular, according to the embodiment, in order to obtain the microbubble-containing liquid MB more efficiently, the microbubble-containing-liquid supply unit 3 has the pressurizer 33 to apply pressure to the liquid in the stocking member 36.

According to the embodiment, in order to supply the microbubble-containing liquid MB to the liquid vat 2 efficiently, the microbubble-containing-liquid supply unit 3 has the liquid-extracting path 91 through which the liquid is extracted from the upper side of the liquid vat 2 to the microbubble generator 32 with the pump 39, the liquid-extracting path 91 is provided to constitute the liquid-circulation system 9 so that the nanobubble-containing liquid NB can be generated in the lower layer of the inner receptacle 21. A part higher than a height of three-quarters of the amount of the liquid that actually remains in the inner receptacle 21 from the bottom is the region that the microbubble occupies, hence the concentration of the nanobubbles can be increased without draining the nanobubbles off toward the pump 39. According to the embodiment, not the nanobubbles existing in the inner receptacle 21 but only the microbubbles are drained toward the pump 39 by extracting the liquid from the upper layer of the inner receptacle 21 that the microbubbles occupies and circulating it toward the pump 39, thereby higher concentration of the nanobubbles can be achieved as dispersion effect affects among the nanobubbles.

The user can stably obtain the nanobubble-containing liquid NB with a particle diameter of about 100 nm or less and a nanobubble concentration of 300 million/ml or more with a synergistic effect by the above configurations in this embodiment as a result.

According to the embodiment, in order to keep efficiency of producing the nanobubble-containing liquid NB high while continuous use, the temperature of the liquid in the liquid vat 2 is controlled within a predetermined temperature range by replacing the medium liquid fittingly.

Unlike the present invention, the Japanese Unexamined Patent Application Publication No. 2005-246293 and so on has proposed a method of applying physical stimulus during circulation using a porous plate as an orifice and a circulation pump, and another method of collapsing with ultrasonic waves and circulating nanobubbles to a minute-bubble-generating device in order to heighten concentration of nanobubbles in a tank, however, the fact that these methods could not obtain high-concentration nanobubbles with a particle diameter of 100 nm or less though microbubbles were converted into nanobubbles with a certain limit is described in the specification thereof. In particular, when circulating the nanobubbles toward the minute-bubble-generating device, difference in the amount of electric charge and zeta potential depending on difference in particular diameter of the bubbles causes cohesion of the bubbles with each other, and besides the nanobubbles in the tank are drained, thus it is impossible to achieve higher concentration. The Japanese Patents No. 3762206 and No. 4094633 are the same.

<Variation 1> Described below are variations of the embodiment. With respect to each variations, the elements that are equivalent to the ones in the above embodiment are given the same reference numerals thereas, the description thereof is omitted.

Figure 10:
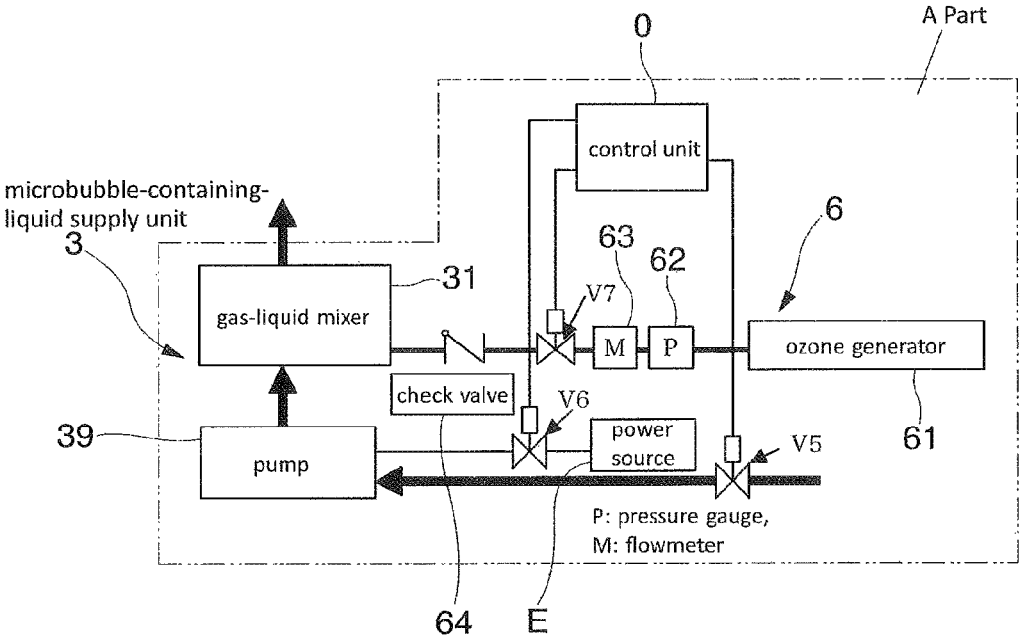
FIG. 10 is an explanatory diagram of the first variation of the embodiment corresponding to FIG. 2.

In a variation 1, the part A in the above embodiment shown in FIG. 2 is replaced with a part A shown in FIG. 10. That is, in this variation, the gas-liquid mixer 31 is provided on a downstream side from a discharge port of the pump 39 to produce the gas-containing liquid, the gas-containing liquid is introduced into the spin member 34 of the microbubble generator 32 so as to produce the microbubble-containing liquid MB. The effect according to the above embodiment can be achieved if the gas-liquid mixer 31 is provided between the pump 39 and the microbubble generator 32 as shown in FIG. 10.

Here, the structure of the spin member 34 may be changed so as to introduce the gas through a middle part of the spin member 34, which is not illustrated. That is, the same effect can be achieved if the spin member 34 also serves as the faculty of the gas-liquid mixer 31.

<Variation 2> According to the above embodiment, the configuration such that the microbubble generator 32 is modularized in an exchangeable manner is presented, more specifically, the generator is configured such that any one module can be selected from among modules having different amount of fluid flowing per a unit of time and can be mounted. The microbubble generator 32 illustrated in FIG. 11 is available to replace the above microbubble generator 32 shown in FIG. 6.

Figure 11:
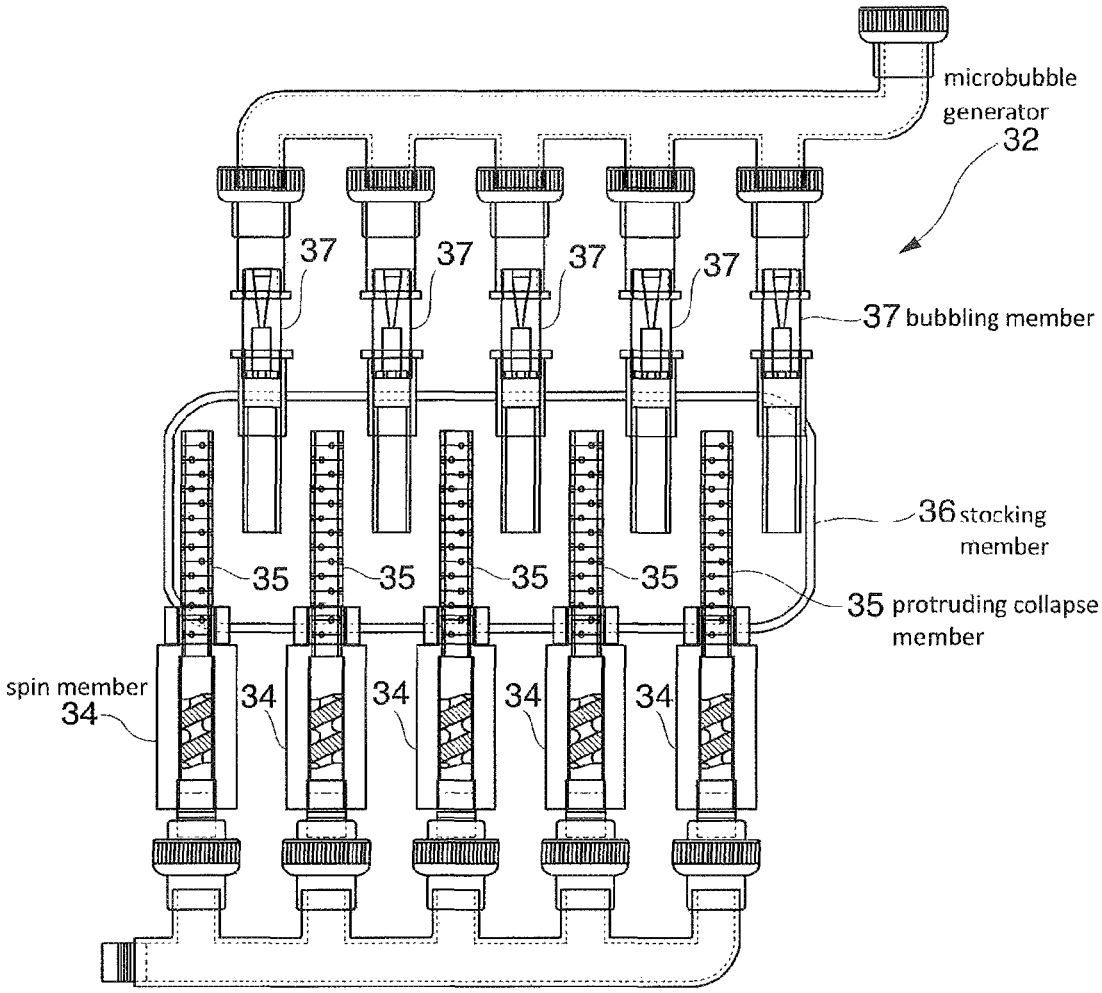
FIG. 11 is an explanatory diagram of an arrangement of the second variation of the embodiment.

The microbubble generator 32 in FIG. 11 may be used in order to obtain a larger amount of the microbubble-containing liquid MB produced per a unit of time than the above embodiment. This microbubble generator 32, which is exchangeable for the one shown in FIG. 6, is configured such that several sets of the spin member 34, the protruding collapse member 35 and the bubbling member 37 are connected with the common stocking member 36 having larger capacity than the one in the above embodiment, and besides those channels join each other in the upstream side and the downstream side. As shown in FIG. 11, the spin members 34, the protruding collapse members 35 and the bubbling members 37 are aligned and paralleled each other, those may be bundled so as to contribute to effectively utilizing space in the cabinet 1.

<Variation 3> According to the embodiment, the mode in that the liquid vat 2 has the outer receptacle 22 formed into a hexagonal shape in the plan view, and the ultrasonic collapse unit 4 uses the six ultrasonic oscillators 41 for the liquid vat 2 is presented. However, the mode illustrated in FIG. 12 may be adopted.

Figure 12:
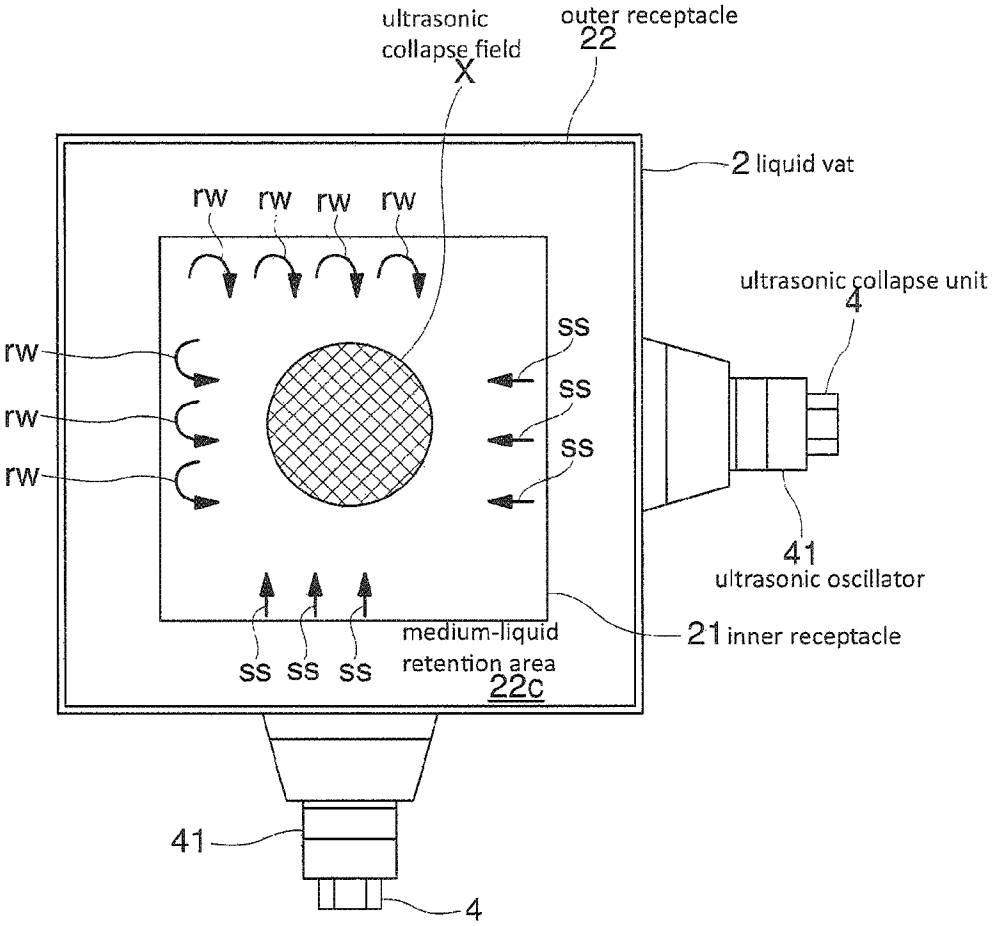
FIG. 12 is an exemplary plan view of the essential part of the third variation of the embodiment.

As shown in FIG. 12, the liquid vat 2 has double-layer structure as with the above embodiment, each of the outer receptacle 22 and the inner receptacle 21 is formed into a rectangular shape in a plan view. Also, the ultrasonic collapse unit 4 has two pairs of the ultrasonic oscillators 41 that are arranged in an opposite axis each. Similarly to the above embodiment, these constitutes a structure where the ultrasonic collapse field X is formed in the inner receptacle 21 with the vibrational energy of the ultrasonic waves ss propagated to the inside of the inner receptacle 21 by the medium liquid.

As shown in FIG. 12, the ultrasonic waves ss propagated from the ultrasonic oscillators 41 is reflected by walls of the outer receptacle 22, the reflected ultrasonic waves rw superpositioned on the ultrasonic waves ss and the ultrasonic waves ss form the ultrasonic collapse field X in the inner receptacle 21. This configuration is characterized by arranging the ultrasonic oscillators 41 in at least the X-axis and the Y-axis, and is able to form the prismatic or columnar ultrasonic collapse field X with radiating and reflecting the ultrasonic waves as with the above embodiment.

Unlike the above configuration, applying ultrasonic waves based on the Japanese Unexamined Patent Application Publications No. 2005-246293 and No. 2011-218308 could not greatly increase concentration of nanobubbles, since microbubbles moved with the energy of applied supersonic waves in the applying direction, and consequently came to the gas-liquid interface, eventually burst.

<Variation 4> According to the embodiment, what is called the circulation-type nanobubble-producing apparatus such that the liquid is circulated between the liquid vat 2 and the microbubble-containing-liquid supply unit 3 is presented. However, as this variation, what is called a one-path-type nanobubble-producing apparatus may be fabricated such that the microbubble-containing-liquid supply unit 3, the supplying path 92, the liquid vat 2 and the ultrasonic collapse unit 4 are provided in order on a single path from the ingredient-liquid supply unit 7 to the nanobubble-containing-liquid extraction portion 5.

Figure 13:
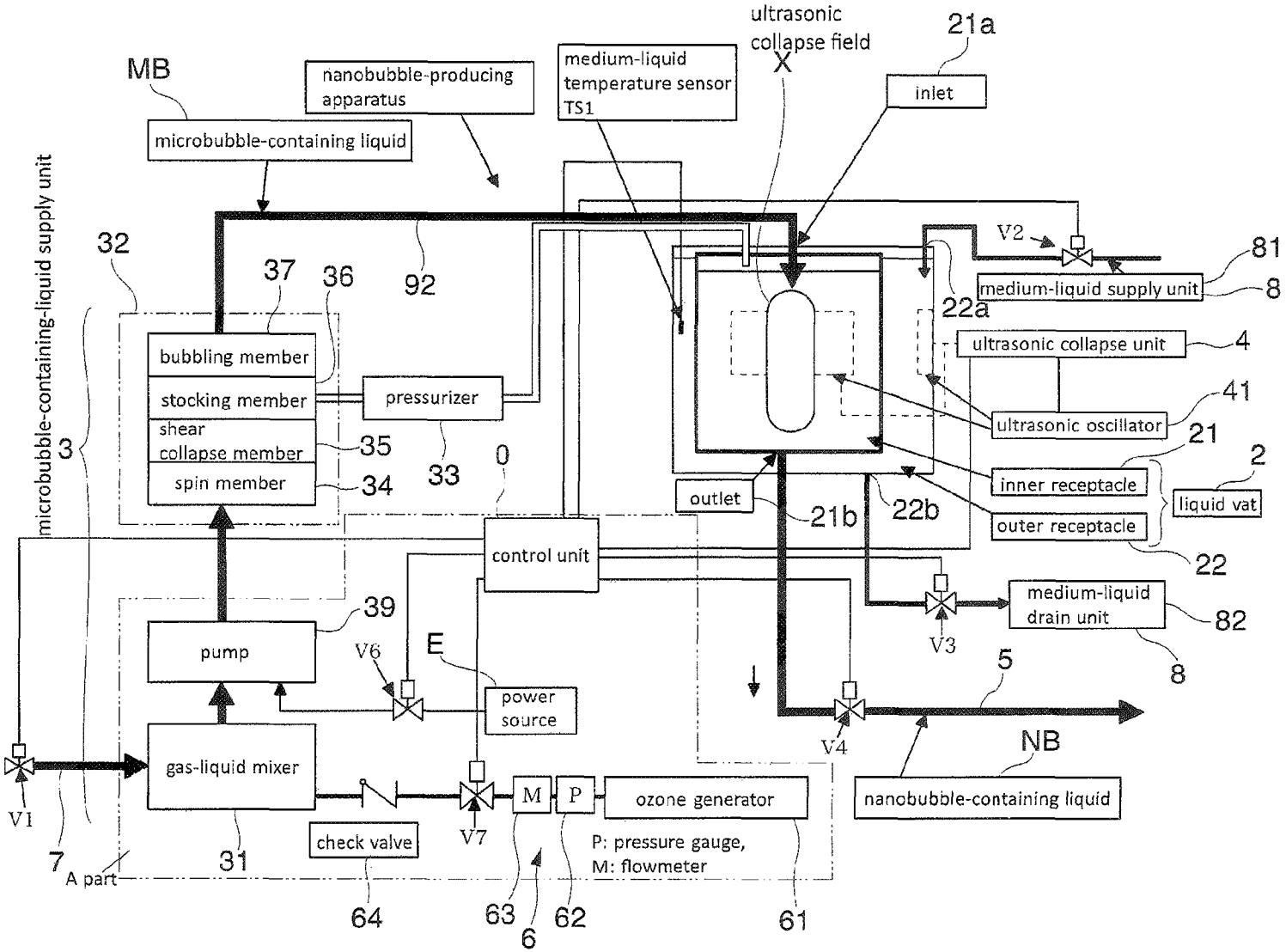
FIG. 13 is an explanatory diagram of the fourth variation of the embodiment corresponding to FIG. 2.
Figure 14:
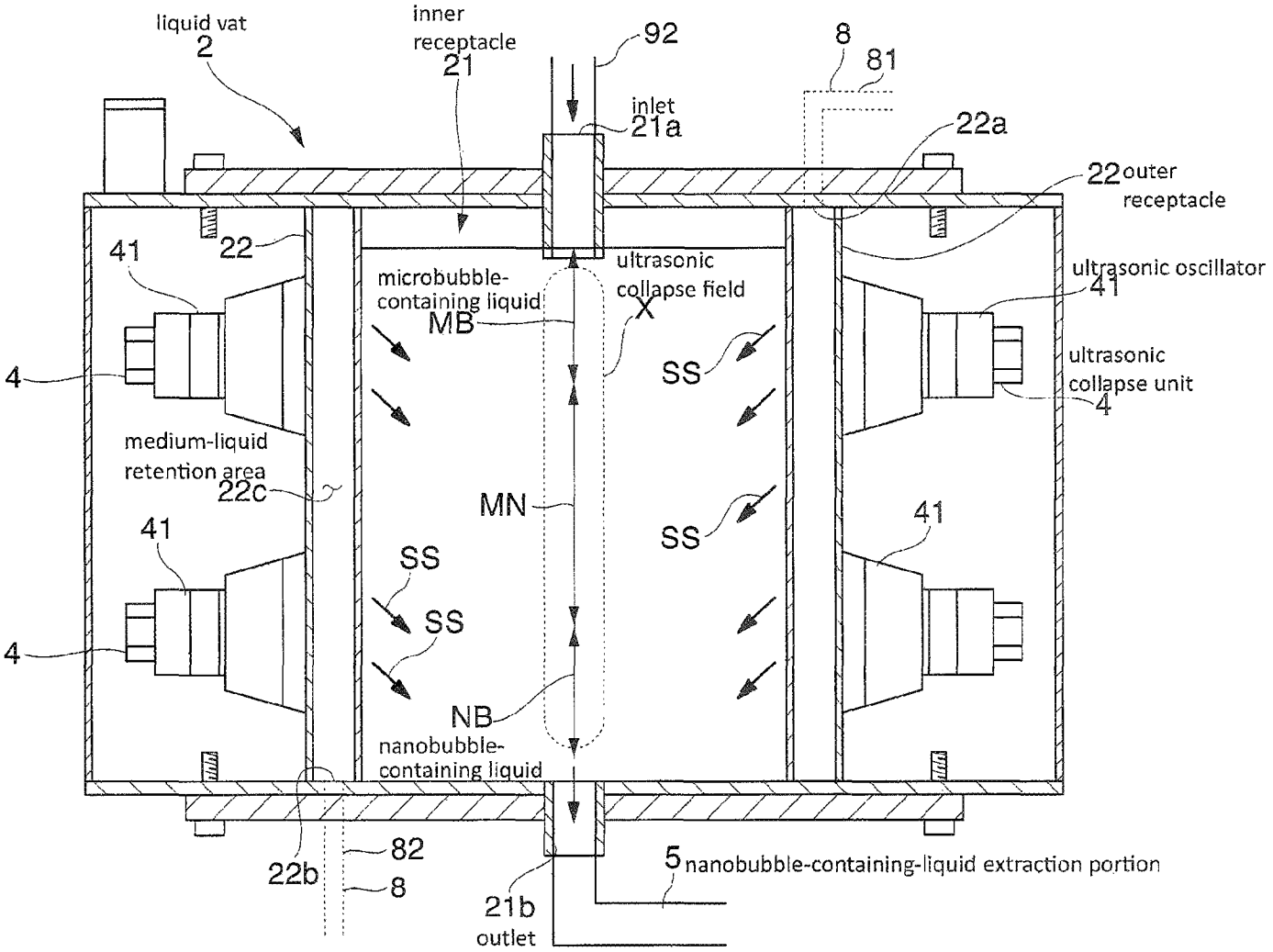
FIG. 14 is an explanatory diagram of the fourth variation of the embodiment corresponding to FIG. 9.

In the nanobubble-producing apparatus of this variation illustrated in FIG. 13, the ingredient-liquid-introducing portion 7 is connected not to the liquid vat but to the gas-liquid mixer 31 of the microbubble-containing-liquid supply unit 3 directly through the valve V1. Also, as shown in FIG. 14, unlike the above embodiment, the liquid vat 2 is provided not with the ingredient-liquid inlet 21*c* and the liquid-extracting outlet 21*d* in the inner receptacle 21 but with the inlet 21*a* ant the outlet 21*b* only.

Such configurations can achieve the same effect as the above embodiment, in other words, can stably obtain the nanobubble-containing liquid NB containing the nanobubbles with requested concentration.

The embodiment and the variations of the present invention have been described above, however, the concrete structures of the respective components are not limited to the above embodiment, various modifications are possible without departing from the scope and spirit of the present invention.

For example, though the nanobubble-containing liquid is directly extracted from the inner receptacle in the above embodiment, an additional tank to store the nanobubble-containing liquid only may be provided on a downstream side from the inner receptacle. Though the liquid vat has double-layer structure with the outer receptacle and the inner receptacle, the structure of the liquid vat is not limited to that, the liquid vat may have single structure with only the outer receptacle in which the ultrasonic collapse field is formed directly. In other words, the medium liquid may be not used. Also, the specific conditions of the pump and the ultrasonic oscillators are not limited to the above embodiment, various ones including existing products are usable.

Regarding to the concrete structures of the respective components, various modifications are possible without departing from the scope and spirit of this invention.

INDUSTRIAL APPLICABILITY

The present invention can be utilized as a nanobubble-producing apparatus to produce nanobubble-containing liquid.

DESCRIPTION OF THE REFERENCE NUMERAL

2 liquid vat
21 inner receptacle
21*a* bubble-containing-liquid inlet (inlet)
21*b* bubble-containing-liquid outlet (outlet)

22 outer receptacle
22*c* medium-liquid retention area
3 microbubble-containing-liquid supply unit
31 gas-liquid mixer
32 microbubble generator
33 pressurizer
34 spin member
35 protruding collapse member
36 stocking member
37 bubbling member
39 pump
4 ultrasonic collapse unit
41 ultrasonic oscillator
5 nanobubble-containing-liquid extraction portion
MB microbubble-containing liquid
NB nanobubble-containing liquid
X ultrasonic collapse field

The invention claimed is:

1. A nanobubble-producing apparatus comprising:

a liquid vat provided with a bubble-containing-liquid inlet and a bubble-containing-liquid outlet;

a microbubble-containing-liquid supply unit to supply microbubble-containing liquid that contains microbubbles to the bubble-containing-liquid inlet of the liquid vat;

an ultrasonic collapse unit to radiate ultrasonic waves to an inside of the liquid vat so that an ultrasonic collapse field in which the collapsing of the microbubbles with the ultrasonic waves is concentrated and nanobubbles are generated is formed at a location where the microbubble-containing liquid supplied into the liquid vat through the bubble-containing-liquid inlet flows; and a nanobubble-containing-liquid extraction portion where nanobubble-containing liquid that contains the nanobubbles generated by the ultrasonic collapse unit is taken out of the liquid vat through the bubble-containing-liquid outlet, wherein the ultrasonic collapse unit includes a plurality of an ultrasonic oscillators that are able to emit the ultrasonic waves, wherein the liquid vat includes:

an outer receptacle to which the plurality of ultrasonic oscillators are fixed and radially arranged in a plan view; and an inner receptacle that is formed inside the outer receptacle, the inner receptacle being provided with the bubble-containing-liquid inlet and the bubble-containing-liquid outlet, wherein a medium-liquid retention area for storing medium liquid to propagate the ultrasonic waves to the inner receptacle is formed between the outer receptacle and the inner receptacle, and wherein the microbubble-containing-liquid supply unit includes:

a gas-liquid mixer to mix liquid with gas;

a microbubble generator that makes the microbubble-containing-liquid of the liquid mixed with the gas by the gas-liquid mixer; and a pump acting to discharge the microbubble-containing-liquid into the bubble-containing-liquid inlet.

2. The nanobubble-producing apparatus according to claim 1, wherein the bubble-containing-liquid inlet is provided in an upper part of the liquid vat, and the bubble-containing-liquid outlet is provided in a bottom part of the liquid vat.

3. The nanobubble-producing apparatus according to claim 1, wherein the bubble-containing-liquid inlet is located in a center of the liquid vat in a plan view, the ultrasonic collapse unit forms the ultrasonic collapse field in the center of the liquid vat in the plan view.

4. The nanobubble-producing apparatus according to claim 1, wherein an oscillation frequency of the ultrasonic waves is set to 0.02-1.5 MHz.

5. The nanobubble-producing apparatus according to claim 4, wherein the inner receptacle has a hermetic structure to be isolated from room air.

6. The nanobubble-producing apparatus according to claim 1, wherein the ultrasonic collapse unit has a plurality of the ultrasonic oscillators.

7. The nanobubble-producing apparatus according to claim 6, wherein the inner receptacle is formed into a circular shape in a plan view, the ultrasonic oscillators are radially arranged in the plan view so as to be able to emit the ultrasonic waves toward a center of the inner receptacle.

8. The nanobubble-producing apparatus according to claim 6, wherein the ultrasonic oscillators are radially arranged so as to emit the ultrasonic waves along a direction inclined downward.

9. The nanobubble-producing apparatus according to claim 1, wherein the gas-liquid mixer is provided on an upper side from the pump in a stream of the liquid.

10. The nanobubble-producing apparatus according to claim 1, wherein the gas-liquid mixer is provided between the pump and the microbubble generator.

11. The nanobubble-producing apparatus according to claim 1, wherein the microbubble generator has a spin member to spin the gas-containing-liquid after passing through the gas-liquid mixer spirally, a protruding collapse member to make the gas-containing-liquid after passing through the spin member go colliding against a protrusion thereof, a stocking member to make the gas-containing-liquid after passing through the protruding collapse member convect for a certain time, and a bubbling member to bubble the gas-containing-liquid after passing through the stocking member and make the microbubble-containing-liquid of the gas-containing-liquid.

12. The nanobubble-producing apparatus according to claim 11, wherein the microbubble-containing-liquid supply unit has a pressurizer to apply pressure to the liquid in the stocking member.

13. The nanobubble-producing apparatus according to claim 1, wherein the microbubble generator is modularized in an exchangeable manner.

14. The nanobubble-producing apparatus according to claim 13, wherein the microbubble generator is configured such that any one module can be selected from among modules having different amount of fluid flowing per a unit of time and can be mounted.

15. The nanobubble-producing apparatus according to claim 1, wherein the microbubble-containing-liquid supply unit has a liquid-extracting path through which the liquid is extracted from an upper side of the liquid vat to the microbubble generator with the pump.

16. The nanobubble-producing apparatus according to claim 1, wherein the nanobubble-producing apparatus comprises a liquid-temperature control unit to control temperature of the liquid in the liquid vat within a predetermined temperature range.

17. A nanobubble-producing apparatus comprising:

a liquid vat comprising an outer receptacle and an inner receptacle formed in the outer receptacle;

a microbubble-containing-liquid supply unit to supply microbubble-containing liquid that contains microbubbles to the liquid vat;

an ultrasonic collapse unit to radiate ultrasonic waves to an inside of the liquid vat so that an ultrasonic collapse field in which the collapsing of the microbubbles with the ultrasonic waves is concentrated and nanobubbles are generated;

a nanobubble-containing-liquid extraction portion where nanobubble-containing liquid that contains the nanobubbles generated by the ultrasonic collapse unit is taken out of the liquid vat; and a medium-liquid retention area formed between the outer receptacle and the inner receptacle and storing medium liquid for propagating the ultrasonic waves to the inner receptacle, wherein the ultrasonic collapse unit includes a plurality of an ultrasonic oscillators that are able to emit the ultrasonic waves, wherein the liquid vat includes:

an outer receptacle to which the plurality of ultrasonic oscillators are fixed and radially arranged in a plan view; and an inner receptacle that is formed inside the outer receptacle, the inner receptacle being provided with the bubble-containing-liquid inlet and the bubble-containing-liquid outlet, and wherein the microbubble-containing-liquid supply unit includes:

a gas-liquid mixer to mix liquid with gas;

a microbubble generator that makes the microbubble-containing-liquid of the liquid mixed with the gas by the gas-liquid mixer; and a pump acting to discharge the microbubble-containing-liquid into the bubble-containing-liquid inlet.

18. The nanobubble-producing apparatus of claim 17, wherein the inner receptacle of the liquid vat comprises:

a bubble-containing-liquid inlet, the microbubble-containing-liquid supply unit supplying the microbubble-containing liquid to the bubble-containing-liquid inlet, and the ultrasonic collapse unit being formed at a location where the microbubble-containing liquid supplied into the liquid vat through the bubble-containing-liquid inlet flows; and a bubble-containing-liquid outlet, the nanobubble-containing liquid being taken out of the liquid vat through the bubble-containing-liquid outlet.

19. The nanobubble-producing apparatus of claim 18, wherein the ultrasonic collapse unit comprises an ultrasonic oscillator that is fixed to the outer receptacle of the liquid vat and emits the ultrasonic waves.

* * * * *